US012677922B2

(12) United States Patent
Salguero

(10) Patent No.: US 12,677,922 B2
(45) Date of Patent: Jul. 14, 2026

(54) ATTACHMENT FOR HAIR CARE APPLIANCE

(71) Applicant: SharkNinja Operating LLC, Needham, MA (US)

(72) Inventor: Victor Salguero, Waltham, MA (US)

(73) Assignee: SharkNinja Operating LLC, Needham, MA (US)

( * ) Notice: Subject to any disclaimer, the term of this patent is extended or adjusted under 35 U.S.C. 154(b) by 721 days.

(21) Appl. No.: 18/174,769

(22) Filed: Feb. 27, 2023

(65) Prior Publication Data

US 2024/0285055 A1 Aug. 29, 2024

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 20/50; A45D 20/12
See application file for complete search history.

(56) References Cited

U.S. PATENT DOCUMENTS

| | | | |
|---|---|---|---|
| 6,895,975 | B2 | 5/2005 | Hafemann |
| 6,996,916 | B2 | 2/2006 | Cafaro |
| 7,040,037 | B2 | 5/2006 | Keong |
| 7,661,174 | B2 | 2/2010 | Park |
| 8,066,017 | B1 | 11/2011 | Born et al. |
| 8,209,877 | B2 | 7/2012 | Smal |
| 8,407,913 | B2 | 4/2013 | Langley et al. |
| 8,602,038 | B2 | 12/2013 | Choi |
| D715,995 | S | 10/2014 | Dyson et al. |
| D715,996 | S | 10/2014 | Dyson et al. |
| D716,492 | S | 10/2014 | Dyson et al. |
| 8,869,808 | B2 | 10/2014 | De Benedictis |
| D729,447 | S | 5/2015 | Gammack |
| D729,448 | S | 5/2015 | Gammack |
| D729,978 | S | 5/2015 | Bates et al. |
| D729,979 | S | 5/2015 | Gammack |

(Continued)

FOREIGN PATENT DOCUMENTS

| | | | |
|---|---|---|---|
| AU | 2011342980 | B2 | 7/2014 |
| AU | 2011298168 | B2 | 2/2015 |

(Continued)

OTHER PUBLICATIONS

International Search Report and Written Opinion received for PCT Patent Application No. PCT/US2024/014192, mailed on Apr. 26, 2024, 16 pages.

*Primary Examiner* — David J Laux
(74) *Attorney, Agent, or Firm* — Finnegan, Henderson, Farabow, Garrett & Dunner, LLP

(57) ABSTRACT

An attachment for a hair care appliance is provided and can include a nozzle defining a primary air flow path extending between a first air inlet and a first air outlet. The attachment can also include a cover coupled to the nozzle such that the cover and nozzle together define a secondary air flow path between a second air inlet and a second air outlet. The attachment can further include a hollow cylindrical barrel coupled to the nozzle and positioned to receive air flowing out of the first air outlet circumferentially there around. The hollow cylindrical barrel can be configured to direct the first air flow path around at least a portion of the outer circumference of the hollow cylindrical barrel.

19 Claims, 17 Drawing Sheets

(56) References Cited

U.S. PATENT DOCUMENTS

D730,575 S 5/2015 Bates et al.
D730,576 S 5/2015 Gammack
9,027,570 B2 5/2015 De Benedictis et al.
D731,117 S 6/2015 Bates et al.
9,144,286 B2 9/2015 Courtney et al.
D741,544 S 10/2015 Gammack
9,173,468 B2 11/2015 Moloney et al.
9,237,789 B2 1/2016 Prehodka
9,282,799 B2 3/2016 Courtney et al.
9,282,800 B2 3/2016 Courtney et al.
D757,361 S 5/2016 Gammack
D757,362 S 5/2016 Dyson et al.
D758,010 S 5/2016 Bates et al.
D758,011 S 5/2016 Gammack
D758,012 S 5/2016 Bates et al.
9,414,662 B2 8/2016 Moloney et al.
9,420,864 B2 8/2016 Gammack et al.
9,510,395 B2 11/2016 Coulton et al.
D775,419 S 12/2016 Stephens et al.
9,516,938 B2 12/2016 Richmond et al.
9,526,310 B2 12/2016 Courtney et al.
9,578,943 B2 2/2017 Guy-rabi et al.
9,578,945 B2 2/2017 Han
D782,731 S 3/2017 Smith et al.
D782,732 S 3/2017 Smith et al.
D782,733 S 3/2017 Smith et al.
D782,735 S 3/2017 Stephens et al.
D782,736 S 3/2017 Stephens et al.
9,591,906 B2 3/2017 Guy-rabi et al.
9,596,916 B2 3/2017 Moloney et al.
D784,614 S 4/2017 Stephens et al.
D785,240 S 4/2017 Smith et al.
D785,241 S 4/2017 Stephens et al.
9,629,434 B2 4/2017 Debenedictis et al.
9,675,157 B2 6/2017 Courtney et al.
9,687,058 B2 6/2017 Atkinson
D791,407 S 7/2017 Smith et al.
D798,502 S 9/2017 Smith et al.
9,788,625 B2 10/2017 De Benedictis et al.
9,808,061 B2 11/2017 Ford et al.
9,808,065 B2 11/2017 Moloney et al.
9,808,067 B2 11/2017 Sutter et al.
9,854,891 B2 1/2018 De Benedictis
9,877,562 B2 1/2018 Guy-rabi et al.
D811,009 S 2/2018 Smith et al.
9,936,788 B2 4/2018 Stephens et al.
9,936,789 B2 4/2018 Stephens et al.
D817,007 S 5/2018 Guy-rabi et al.
10,010,150 B2 7/2018 Courtney et al.
10,016,040 B2 7/2018 Courtney et al.
10,021,951 B2 7/2018 Bobillier et al.
10,064,470 B2 9/2018 Warne
D830,630 S 10/2018 Chia et al.
10,085,537 B2 10/2018 Maclaine
10,085,538 B2 10/2018 Saunders et al.
10,117,491 B2 11/2018 Moloney et al.
10,143,285 B2 12/2018 Stephens et al.
10,165,843 B2 1/2019 Hedges
10,165,844 B2 1/2019 Stephens et al.
10,186,822 B2 1/2019 Hogan
10,194,728 B2 2/2019 Stephens et al.
10,213,001 B2 2/2019 Stephens et al.
D843,652 S 3/2019 Mcluckie et al.
D843,653 S 3/2019 Teyu et al.
D843,654 S 3/2019 Teyu et al.
10,226,112 B2 3/2019 Kerr et al.
10,238,199 B2 3/2019 Stephens et al.
D847,421 S 4/2019 Tappenden et al.
D847,422 S 4/2019 Tappenden et al.
D847,423 S 4/2019 Tappenden et al.
D847,424 S 4/2019 Tappenden et al.
D847,425 S 4/2019 Tappenden et al.
D847,426 S 4/2019 Tappenden et al.
D848,063 S 5/2019 Tappenden et al.
D848,064 S 5/2019 Tappenden et al.
D848,065 S 5/2019 Heffer et al.
D848,066 S 5/2019 Coulton et al.
D848,067 S 5/2019 Heffer et al.
D848,068 S 5/2019 Heffer et al.
D848,675 S 5/2019 Chia et al.
D850,001 S 5/2019 Coulton et al.
10,278,471 B2 5/2019 Shelton et al.
D852,415 S 6/2019 Coulton et al.
D852,416 S 6/2019 Coulton et al.
10,306,965 B2 6/2019 Wilkinson et al.
D853,637 S 7/2019 Coulton et al.
D853,638 S 7/2019 Tappenden et al.
D853,639 S 7/2019 Tappenden et al.
D853,640 S 7/2019 Tappenden et al.
D853,641 S 7/2019 Tappenden et al.
D853,642 S 7/2019 Coulton et al.
D854,745 S 7/2019 Chia et al.
D855,252 S 7/2019 Coulton et al.
D856,579 S 8/2019 Chia et al.
D856,580 S 8/2019 Chia et al.
10,383,422 B2 8/2019 Law et al.
10,390,599 B1 8/2019 James et al.
D860,528 S 9/2019 Atkinson et al.
D860,529 S 9/2019 Atkinson et al.
D860,530 S 9/2019 Atkinson et al.
D860,531 S 9/2019 Atkinson et al.
D860,532 S 9/2019 Atkinson et al.
D865,286 S 10/2019 Atkinson et al.
10,441,049 B2 10/2019 Douglas et al.
10,441,050 B2 10/2019 Blanc et al.
10,448,722 B2 10/2019 Mcluckie
10,470,545 B2 11/2019 Thiebaut et al.
D869,763 S 12/2019 Atkinson et al.
D869,764 S 12/2019 Atkinson et al.
10,575,617 B2 3/2020 Courtney et al.
10,582,751 B2 3/2020 Courtney
10,602,826 B2 3/2020 Wilkinson et al.
10,610,000 B2 4/2020 Courtney et al.
D884,966 S 5/2020 Flynn et al.
D885,663 S 5/2020 Flynn et al.
10,660,417 B2 5/2020 Bennett
10,660,418 B2 5/2020 Degrood et al.
10,687,595 B2 6/2020 Courtney et al.
10,729,218 B2 8/2020 Childe et al.
10,765,191 B2 9/2020 Stephens et al.
10,786,061 B2 9/2020 Thiebaut et al.
10,849,400 B2 12/2020 Weatherly et al.
10,869,529 B2 12/2020 Chia et al.
10,874,186 B2 * 12/2020 MacPherson ..... A45D 20/122
10,973,298 B2 4/2021 Kennedy et al.
D923,874 S 6/2021 Kirkbride et al.
11,033,088 B2 6/2021 Atkinson et al.
11,044,979 B2 6/2021 Maclaine
11,071,365 B2 7/2021 Maclaine et al.
11,168,924 B2 11/2021 Naicker et al.
11,172,745 B2 11/2021 Tam et al.
11,296,621 B2 4/2022 Zheng et al.
11,330,884 B2 5/2022 Degrood et al.
11,589,660 B2 2/2023 Thompson et al.
11,589,661 B2 2/2023 Guerreiro et al.
D1,078,159 S * 6/2025 Jiang ..... D28/40
2016/0262518 A1 9/2016 Guy-rabi et al.
2017/0273428 A1 9/2017 Nicolson et al.
2017/0273429 A1 9/2017 Nicolson et al.
2017/0310249 A1 10/2017 Zheng et al.
2018/0055182 A1 3/2018 Thompson et al.
2019/0223572 A1 7/2019 Ahrens
2019/0357653 A1 11/2019 Guerreiro et al.
2019/0357654 A1 * 11/2019 MacPherson ..... A45D 20/12
2019/0380463 A1 12/2019 Guerreiro et al.
2020/0037725 A1 2/2020 Ahrens
2020/0085163 A1 3/2020 James et al.
2020/0237070 A1 7/2020 Degrood et al.
2020/0397111 A1 12/2020 Bouchar
2021/0000237 A1 1/2021 Kennedy et al.
2021/0285328 A1 9/2021 Mahmoodilari et al.
2021/0381527 A1 12/2021 Peet et al.

(56) References Cited

U.S. PATENT DOCUMENTS

| | | | |
|---|---|---|---|
| 2022/0160096 | A1 | 5/2022 | Harrison et al. |
| 2022/0190751 | A1 | 6/2022 | Zheng et al. |

FOREIGN PATENT DOCUMENTS

| | | | |
|---|---|---|---|
| AU | 2013239504 | B2 | 4/2015 |
| AU | 2013239510 | B2 | 10/2015 |
| AU | 2013285200 | B2 | 11/2015 |
| AU | 2013285201 | B2 | 1/2016 |
| AU | 2014202857 | B2 | 8/2016 |
| AU | 2014389903 | A1 | 9/2016 |
| AU | 2013283014 | B2 | 2/2017 |
| AU | 2014285903 | B2 | 2/2017 |
| AU | 2013261059 | B2 | 5/2017 |
| AU | 2014285903 | C1 | 5/2017 |
| AU | 201714987 | S | 9/2017 |
| AU | 201714988 | S | 9/2017 |
| AU | 2015233175 | B2 | 9/2017 |
| AU | 201715704 | S | 10/2017 |
| AU | 201715709 | S | 10/2017 |
| AU | 201715713 | S | 10/2017 |
| AU | 201717218 | S | 12/2017 |
| AU | 201717219 | S | 12/2017 |
| AU | 201717220 | S | 12/2017 |
| AU | 201717221 | S | 12/2017 |
| AU | 201717222 | S | 12/2017 |
| AU | 201717232 | S | 12/2017 |
| AU | 201717235 | S | 12/2017 |
| AU | 201717236 | S | 12/2017 |
| AU | 201717237 | S | 12/2017 |
| AU | 201717246 | S | 12/2017 |
| AU | 2015233174 | B2 | 12/2017 |
| AU | 201810343 | S | 2/2018 |
| AU | 201810344 | S | 2/2018 |
| AU | 201810345 | S | 2/2018 |
| AU | 201810346 | S | 2/2018 |
| AU | 201810348 | S | 2/2018 |
| AU | 201810466 | S | 2/2018 |
| AU | 201810467 | S | 2/2018 |
| AU | 201810472 | S | 2/2018 |
| AU | 2017101822 | A4 | 2/2018 |
| AU | 201811153 | S | 3/2018 |
| AU | 201811154 | S | 3/2018 |
| AU | 201811828 | S | 4/2018 |
| AU | 2016277577 | B2 | 8/2018 |
| AU | 2018204763 | A1 | 1/2019 |
| AU | 2018201042 | B2 | 8/2019 |
| AU | 2017318546 | B2 | 7/2020 |
| AU | 2017393026 | B2 | 12/2020 |
| AU | 2018441457 | A1 | 4/2021 |
| CA | 2873465 | A1 | 11/2013 |
| CA | 2943399 | A1 | 9/2015 |
| CA | 3011101 | A1 | 1/2019 |
| CA | 3109771 | A1 | 3/2020 |
| CN | 101662969 | B | 8/2011 |
| CN | 203168302 | U | 9/2013 |
| CN | 203168303 | U | 9/2013 |
| CN | 203220053 | U | 10/2013 |
| CN | 203328162 | U | 12/2013 |
| CN | 203369521 | U | 1/2014 |
| CN | 203369522 | U | 1/2014 |
| CN | 203524054 | U | 4/2014 |
| CN | 101896091 | B | 8/2014 |
| CN | 104287408 | A | 1/2015 |
| CN | 204292438 | U | 4/2015 |
| CN | 204317818 | U | 5/2015 |
| CN | 204483371 | U | 7/2015 |
| CN | 204483372 | U | 7/2015 |
| CN | 204483373 | U | 7/2015 |
| CN | 204499778 | U | 7/2015 |
| CN | 104921436 | A | 9/2015 |
| CN | 104921437 | A | 9/2015 |
| CN | 104968235 | A | 10/2015 |
| CN | 204742992 | U | 11/2015 |
| CN | 204796991 | U | 11/2015 |
| CN | 204796992 | U | 11/2015 |
| CN | 103565076 | B | 12/2015 |
| CN | 105231630 | A | 1/2016 |
| CN | 103355925 | B | 2/2016 |
| CN | 103228170 | B | 3/2016 |
| CN | 103549750 | B | 3/2016 |
| CN | 105433576 | A | 3/2016 |
| CN | 103237475 | B | 5/2016 |
| CN | 102665479 | B | 7/2016 |
| CN | 103355930 | B | 8/2016 |
| CN | 103519541 | B | 8/2016 |
| CN | 205456831 | U | 8/2016 |
| CN | 106256283 | A | 12/2016 |
| CN | 106256286 | A | 12/2016 |
| CN | 205963257 | U | 2/2017 |
| CN | 205963258 | U | 2/2017 |
| CN | 103355927 | B | 3/2017 |
| CN | 205993856 | U | 3/2017 |
| CN | 206043777 | U | 3/2017 |
| CN | 206043778 | U | 3/2017 |
| CN | 206043779 | U | 3/2017 |
| CN | 103355926 | B | 4/2017 |
| CN | 103355928 | B | 4/2017 |
| CN | 103355929 | B | 4/2017 |
| CN | 103519540 | B | 4/2017 |
| CN | 206150740 | U | 5/2017 |
| CN | 206295038 | U | 7/2017 |
| CN | 206338218 | U | 7/2017 |
| CN | 206354632 | U | 7/2017 |
| CN | 107006989 | A | 8/2017 |
| CN | 206517192 | U | 9/2017 |
| CN | 107224080 | A | 10/2017 |
| CN | 206651501 | U | 11/2017 |
| CN | 206699677 | U | 12/2017 |
| CN | 206744836 | U | 12/2017 |
| CN | 104026843 | B | 1/2018 |
| CN | 104337192 | B | 1/2018 |
| CN | 104042020 | B | 2/2018 |
| CN | 207023591 | U | 2/2018 |
| CN | 207023592 | U | 2/2018 |
| CN | 104411205 | B | 3/2018 |
| CN | 107788666 | A | 3/2018 |
| CN | 104042022 | B | 4/2018 |
| CN | 207168088 | U | 4/2018 |
| CN | 207322932 | U | 5/2018 |
| CN | 207322933 | U | 5/2018 |
| CN | 207355685 | U | 5/2018 |
| CN | 104273921 | B | 6/2018 |
| CN | 108135342 | A | 6/2018 |
| CN | 207544575 | U | 6/2018 |
| CN | 207544576 | U | 6/2018 |
| CN | 108402637 | A | 8/2018 |
| CN | 108567216 | A | 9/2018 |
| CN | 207803715 | U | 9/2018 |
| CN | 104273917 | B | 10/2018 |
| CN | 104273919 | B | 10/2018 |
| CN | 104510138 | B | 10/2018 |
| CN | 207927983 | U | 10/2018 |
| CN | 207939324 | U | 10/2018 |
| CN | 104273920 | B | 11/2018 |
| CN | 104510137 | B | 11/2018 |
| CN | 208144697 | U | 11/2018 |
| CN | 105392386 | A | 12/2018 |
| CN | 108991700 | A | 12/2018 |
| CN | 208339134 | U | 1/2019 |
| CN | 104273918 | B | 2/2019 |
| CN | 208463170 | U | 2/2019 |
| CN | 208524016 | U | 2/2019 |
| CN | 105559311 | B | 4/2019 |
| CN | 106989039 | B | 5/2019 |
| CN | 209073632 | U | 7/2019 |
| CN | 104921435 | B | 8/2019 |
| CN | 106256287 | B | 8/2019 |
| CN | 110074535 | A | 8/2019 |
| CN | 106165958 | B | 9/2019 |
| CN | 106333459 | B | 9/2019 |
| CN | 105639974 | B | 10/2019 |
| CN | 110325073 | A | 10/2019 |
| CN | 209573664 | U | 11/2019 |

(56) References Cited

FOREIGN PATENT DOCUMENTS

| | | | |
|---|---|---|---|
| CN | 110582215 | A | 12/2019 |
| CN | 105473022 | B | 2/2020 |
| CN | 210055005 | U | 2/2020 |
| CN | 210055006 | U | 2/2020 |
| CN | 106256282 | B | 3/2020 |
| CN | 111202335 | A | 5/2020 |
| CN | 105686301 | B | 6/2020 |
| CN | 105795679 | B | 6/2020 |
| CN | 111248594 | A | 6/2020 |
| CN | 104042021 | B | 7/2020 |
| CN | 111432684 | A | 7/2020 |
| CN | 106820534 | B | 8/2020 |
| CN | 211154233 | U | 8/2020 |
| CN | 105407757 | B | 10/2020 |
| CN | 106880155 | B | 10/2020 |
| CN | 106974416 | B | 10/2020 |
| CN | 106974415 | B | 11/2020 |
| CN | 107847031 | B | 11/2020 |
| CN | 108206600 | B | 11/2020 |
| CN | 211984215 | U | 11/2020 |
| CN | 211984221 | U | 11/2020 |
| CN | 108272207 | B | 12/2020 |
| CN | 212185556 | U | 12/2020 |
| CN | 112336037 | A | 2/2021 |
| CN | 108618334 | B | 4/2021 |
| CN | 106963093 | B | 5/2021 |
| CN | 108618333 | B | 5/2021 |
| CN | 213096652 | U | 5/2021 |
| CN | 213215774 | U | 5/2021 |
| CN | 106165959 | B | 6/2021 |
| CN | 107224085 | B | 6/2021 |
| CN | 107317521 | B | 6/2021 |
| CN | 106256284 | B | 7/2021 |
| CN | 113080592 | A | 7/2021 |
| CN | 105407756 | B | 8/2021 |
| CN | 106901482 | B | 8/2021 |
| CN | 107224087 | B | 8/2021 |
| CN | 107224077 | B | 9/2021 |
| CN | 113437901 | A | 9/2021 |
| CN | 109247685 | B | 10/2021 |
| CN | 109788833 | B | 11/2021 |
| CN | 113786051 | A | 12/2021 |
| CN | 109674176 | B | 3/2022 |
| CN | 114176301 | A | 3/2022 |
| CN | 108851461 | B | 6/2022 |
| CN | 114680439 | A | 7/2022 |
| CO | 6721018 | A2 | 7/2013 |
| CR | 20130272 | A | 1/2014 |
| EP | 1779745 | B1 | 5/2008 |
| EP | 2242393 | B1 | 4/2013 |
| EP | 2611329 | B1 | 8/2014 |
| EP | 2736375 | B1 | 9/2015 |
| EP | 2651260 | B1 | 10/2015 |
| EP | 2745729 | B1 | 11/2015 |
| EP | 2656746 | B1 | 12/2015 |
| EP | 3119235 | A1 | 1/2017 |
| EP | 3119236 | A1 | 1/2017 |
| EP | 2975966 | B1 | 4/2017 |
| EP | 2736374 | B1 | 6/2017 |
| EP | 2863770 | B1 | 6/2017 |
| EP | 2862476 | B1 | 1/2018 |
| EP | 3324782 | A1 | 5/2018 |
| EP | 2830462 | B1 | 6/2018 |
| EP | 3016545 | B1 | 6/2018 |
| EP | 3158890 | B1 | 8/2018 |
| EP | 2849605 | B1 | 10/2018 |
| EP | 3024352 | B1 | 10/2018 |
| EP | 3335586 | B1 | 11/2018 |
| EP | 3206523 | B1 | 12/2018 |
| EP | 3016541 | B1 | 1/2019 |
| EP | 3235397 | B1 | 2/2019 |
| EP | 3310207 | B1 | 2/2019 |
| EP | 2611328 | B1 | 3/2019 |
| EP | 3079521 | B1 | 4/2019 |
| EP | 3172985 | B1 | 4/2019 |
| EP | 3232853 | B1 | 4/2019 |
| EP | 3016540 | B1 | 5/2019 |
| EP | 3048926 | B1 | 6/2019 |
| EP | 3048925 | B1 | 7/2019 |
| EP | 3506786 | A1 | 7/2019 |
| EP | 3512372 | A1 | 7/2019 |
| EP | 3516986 | A1 | 7/2019 |
| EP | 3364816 | B1 | 10/2019 |
| EP | 3568038 | A1 | 11/2019 |
| EP | 3568039 | A1 | 11/2019 |
| EP | 2830457 | B1 | 12/2019 |
| EP | 2830459 | B1 | 12/2019 |
| EP | 2620075 | B2 | 2/2020 |
| EP | 3622780 | A1 | 3/2020 |
| EP | 2869726 | B1 | 4/2020 |
| EP | 2869727 | B1 | 4/2020 |
| EP | 3432759 | B1 | 6/2020 |
| EP | 3016544 | B1 | 7/2020 |
| EP | 3310204 | B1 | 7/2020 |
| EP | 3687335 | A1 | 8/2020 |
| EP | 3328237 | B1 | 11/2020 |
| EP | 3319473 | B1 | 2/2021 |
| EP | 3432757 | B1 | 2/2021 |
| EP | 3119234 | B1 | 11/2021 |
| EP | 3009027 | B2 | 6/2022 |
| EP | 3849373 | A4 | 6/2022 |
| EP | 3028596 | B1 | 7/2022 |
| EP | 3427609 | B1 | 9/2022 |
| FR | 3039377 | B1 | 9/2017 |
| GB | 2477834 | B | 2/2012 |
| GB | 2455716 | C | 2/2013 |
| GB | 2501175 | B | 4/2014 |
| GB | 2500798 | B | 5/2014 |
| GB | 2500800 | B | 5/2014 |
| GB | 2501379 | B | 5/2014 |
| GB | 2500801 | B | 7/2014 |
| GB | 2511219 | B | 5/2015 |
| GB | 2515809 | B | 8/2015 |
| GB | 2515810 | B | 11/2015 |
| GB | 2515811 | B | 11/2015 |
| GB | 2515812 | B | 2/2016 |
| GB | 2516478 | B | 3/2016 |
| GB | 2518639 | B | 3/2016 |
| GB | 201605028 | | 5/2016 |
| GB | 2497057 | B | 8/2016 |
| GB | 201612054 | | 8/2016 |
| GB | 2531431 | B | 11/2016 |
| GB | 2521144 | B | 12/2016 |
| GB | 2526768 | B | 2/2017 |
| GB | 2516249 | B | 3/2017 |
| GB | 2503683 | B | 4/2017 |
| GB | 2524304 | B | 4/2017 |
| GB | 2526049 | B | 4/2017 |
| GB | 2515813 | B | 7/2017 |
| GB | 2543135 | B | 11/2017 |
| GB | 2533324 | B | 12/2017 |
| GB | 2503687 | B | 2/2018 |
| GB | 2547138 | B | 3/2018 |
| GB | 2534379 | B | 5/2018 |
| GB | 2545412 | B | 6/2018 |
| GB | 2539437 | B | 7/2018 |
| GB | 2540203 | B | 7/2018 |
| GB | 2551852 | B | 9/2018 |
| GB | 201818400 | | 12/2018 |
| GB | 2539432 | B | 1/2019 |
| GB | 2539441 | B | 1/2019 |
| GB | 2543536 | B | 1/2019 |
| GB | 2558415 | B | 2/2019 |
| GB | 2543751 | B | 4/2019 |
| GB | 2549740 | B | 4/2019 |
| GB | 2561093 | B | 4/2019 |
| GB | 2538560 | B | 5/2019 |
| GB | 2561094 | B | 5/2019 |
| GB | 2548822 | B | 8/2019 |
| GB | 2548816 | B | 9/2019 |
| GB | 2548812 | B | 10/2019 |
| GB | 2553516 | B | 1/2020 |
| GB | 2565698 | B | 1/2020 |
| GB | 2548616 | B | 2/2020 |

(56) References Cited

FOREIGN PATENT DOCUMENTS

| | | | |
|---|---|---|---|
| GB | 2548813 | B | 2/2020 |
| GB | 2560888 | B | 4/2020 |
| GB | 2548819 | B | 5/2020 |
| GB | 2557958 | B | 5/2020 |
| GB | 2560889 | B | 9/2020 |
| GB | 2567661 | B | 9/2020 |
| GB | 202015444 | | 11/2020 |
| GB | 202015445 | | 11/2020 |
| GB | 202101269 | | 3/2021 |
| GB | 2562276 | B | 4/2021 |
| GB | 2576017 | B | 4/2021 |
| GB | 202102691 | | 4/2021 |
| GB | 2560356 | B | 5/2021 |
| GB | 2575297 | B | 5/2021 |
| GB | 2581371 | B | 9/2021 |
| GB | 2581372 | B | 12/2021 |
| GB | 2603174 | A | 8/2022 |
| GB | 2603175 | A | 8/2022 |
| GB | 2603176 | A | 8/2022 |
| GB | 2603177 | A | 8/2022 |
| GB | 2580416 | B | 9/2022 |
| JP | 2001527427 | A | 12/2001 |
| JP | 5361906 | B2 | 9/2013 |
| JP | 2013212383 | A | 10/2013 |
| JP | 2013212385 | A | 10/2013 |
| JP | 2013212387 | A | 10/2013 |
| JP | 2013212388 | A | 10/2013 |
| JP | 2014012142 | A | 1/2014 |
| JP | 2014012143 | A | 1/2014 |
| JP | 2014521444 | A | 8/2014 |
| JP | 5636441 | B2 | 10/2014 |
| JP | 2014217770 | A | 11/2014 |
| JP | 5674852 | B2 | 1/2015 |
| JP | 2015013124 | A | 1/2015 |
| JP | 2015013125 | A | 1/2015 |
| JP | 2015013127 | A | 1/2015 |
| JP | 2015023798 | A | 2/2015 |
| JP | 2015024137 | A | 2/2015 |
| JP | 5709926 | B2 | 3/2015 |
| JP | 5722403 | B2 | 4/2015 |
| JP | 2015066446 | A | 4/2015 |
| JP | 2015066447 | A | 4/2015 |
| JP | 2015097941 | A | 5/2015 |
| JP | 5758944 | B2 | 6/2015 |
| JP | 5760030 | B2 | 6/2015 |
| JP | 5780311 | B2 | 7/2015 |
| JP | 2015181946 | A | 10/2015 |
| JP | 2015181947 | A | 10/2015 |
| JP | 5897573 | B2 | 3/2016 |
| JP | 2016040008 | A | 3/2016 |
| JP | 5913465 | B2 | 4/2016 |
| JP | 5923062 | B2 | 4/2016 |
| JP | 2016083586 | A | 5/2016 |
| JP | 5953642 | B2 | 6/2016 |
| JP | 2016112423 | A | 6/2016 |
| JP | 2016112424 | A | 6/2016 |
| JP | 2016129688 | A | 7/2016 |
| JP | 2016129780 | A | 7/2016 |
| JP | 2016131890 | A | 7/2016 |
| JP | 5987256 | B2 | 8/2016 |
| JP | 5990839 | B2 | 8/2016 |
| JP | 2016523648 | A | 8/2016 |
| JP | 6008302 | B2 | 9/2016 |
| JP | 2016526429 | A | 9/2016 |
| JP | 6035635 | B2 | 11/2016 |
| JP | 6069773 | B2 | 1/2017 |
| JP | 2017006664 | A | 1/2017 |
| JP | 2017006665 | A | 1/2017 |
| JP | 2017006666 | A | 1/2017 |
| JP | 2017006668 | A | 1/2017 |
| JP | 2017012789 | A | 1/2017 |
| JP | 2017018593 | A | 1/2017 |
| JP | 2017502735 | A | 1/2017 |
| JP | 6085841 | B2 | 2/2017 |
| JP | 6129943 | B2 | 4/2017 |
| JP | 2017077470 | A | 4/2017 |
| JP | 2017077471 | A | 4/2017 |
| JP | 2017077472 | A | 4/2017 |
| JP | 2017079592 | A | 4/2017 |
| JP | 2017512589 | A | 5/2017 |
| JP | 6151226 | B2 | 6/2017 |
| JP | 6161762 | B2 | 6/2017 |
| JP | 2017140364 | A | 8/2017 |
| JP | 2017148598 | A | 8/2017 |
| JP | 6208265 | B2 | 9/2017 |
| JP | 2017170147 | A | 9/2017 |
| JP | 2017170149 | A | 9/2017 |
| JP | 2017170150 | A | 9/2017 |
| JP | 2017185217 | A | 10/2017 |
| JP | 6243455 | B2 | 11/2017 |
| JP | 2017200432 | A | 11/2017 |
| JP | 2017209536 | A | 11/2017 |
| JP | 6278854 | B2 | 1/2018 |
| JP | 6291523 | B2 | 2/2018 |
| JP | 6297958 | B2 | 3/2018 |
| JP | 2018033968 | A | 3/2018 |
| JP | 2018043010 | A | 3/2018 |
| JP | 6332918 | B2 | 5/2018 |
| JP | 6343633 | B2 | 5/2018 |
| JP | 6344570 | B2 | 6/2018 |
| JP | 2018086277 | A | 6/2018 |
| JP | 2018110514 | A | 7/2018 |
| JP | 6386547 | B2 | 8/2018 |
| JP | 6388217 | B2 | 8/2018 |
| JP | 2018134441 | A | 8/2018 |
| JP | 6416155 | B2 | 10/2018 |
| JP | 2018158110 | A | 10/2018 |
| JP | 2018158111 | A | 10/2018 |
| JP | 2018190728 | A | 11/2018 |
| JP | 6453829 | B2 | 12/2018 |
| JP | 6456879 | B2 | 12/2018 |
| JP | 6475261 | B2 | 2/2019 |
| JP | 6511080 | B2 | 4/2019 |
| JP | 6512713 | B2 | 4/2019 |
| JP | 6518281 | B2 | 4/2019 |
| JP | 6522914 | B2 | 5/2019 |
| JP | 6523157 | B2 | 5/2019 |
| JP | 6533480 | B2 | 5/2019 |
| JP | 2019076720 | A | 5/2019 |
| JP | 6538010 | B2 | 6/2019 |
| JP | 6542180 | B2 | 6/2019 |
| JP | 6556183 | B2 | 7/2019 |
| JP | 6557650 | B2 | 7/2019 |
| JP | 6557695 | B2 | 7/2019 |
| JP | 2019141560 | A | 8/2019 |
| JP | 6585115 | B2 | 9/2019 |
| JP | 6599917 | B2 | 10/2019 |
| JP | 2019193568 | A | 10/2019 |
| JP | 6625527 | B2 | 12/2019 |
| JP | 6634296 | B2 | 12/2019 |
| JP | 6662936 | B2 | 2/2020 |
| JP | 2020505721 | A | 2/2020 |
| JP | 3225772 | U | 3/2020 |
| JP | 2020047605 | A | 3/2020 |
| JP | 3226032 | U | 4/2020 |
| JP | 6723287 | B2 | 6/2020 |
| JP | 6723961 | B2 | 6/2020 |
| JP | 6738839 | B2 | 7/2020 |
| JP | 2020099758 | A | 7/2020 |
| JP | 6779198 | B2 | 10/2020 |
| JP | 6792318 | B2 | 11/2020 |
| JP | 6811290 | B2 | 12/2020 |
| JP | 2020535860 | A | 12/2020 |
| JP | 6838006 | B2 | 2/2021 |
| JP | 6854109 | B2 | 3/2021 |
| JP | 6861790 | B2 | 4/2021 |
| JP | 6890571 | B2 | 5/2021 |
| JP | 2021087838 | A | 6/2021 |
| JP | 6924442 | B2 | 8/2021 |
| JP | 2021166822 | A | 10/2021 |
| JP | 2022509442 | A | 1/2022 |
| KR | 101196487 | B1 | 11/2012 |
| KR | 101229109 | B1 | 2/2013 |
| KR | 20140129309 | A | 11/2014 |

(56) References Cited

FOREIGN PATENT DOCUMENTS

| | | | |
|---|---|---|---|
| KR | 20140129310 | A | 11/2014 |
| KR | 20140129322 | A | 11/2014 |
| KR | 20140129323 | A | 11/2014 |
| KR | 20140129324 | A | 11/2014 |
| KR | 101468416 | B1 | 12/2014 |
| KR | 20140138797 | A | 12/2014 |
| KR | 200475794 | Y1 | 1/2015 |
| KR | 20150023773 | A | 3/2015 |
| KR | 20150023774 | A | 3/2015 |
| KR | 20160020555 | A | 2/2016 |
| KR | 20160020556 | A | 2/2016 |
| KR | 20160020557 | A | 2/2016 |
| KR | 20160020558 | A | 2/2016 |
| KR | 20160021265 | A | 2/2016 |
| KR | 20160021294 | A | 2/2016 |
| KR | 20160021862 | A | 2/2016 |
| KR | 20160052719 | A | 5/2016 |
| KR | 20160052720 | A | 5/2016 |
| KR | 20160052721 | A | 5/2016 |
| KR | 20160075829 | A | 6/2016 |
| KR | 20160075831 | A | 6/2016 |
| KR | 20160079142 | A | 7/2016 |
| KR | 20160079144 | A | 7/2016 |
| KR | 20160079146 | A | 7/2016 |
| KR | 101660347 | B1 | 9/2016 |
| KR | 20160126073 | A | 11/2016 |
| KR | 20160126074 | A | 11/2016 |
| KR | 20160004256 | U | 12/2016 |
| KR | 101693281 | B1 | 1/2017 |
| KR | 20170001743 | A | 1/2017 |
| KR | 101713997 | B1 | 3/2017 |
| KR | 101726280 | B1 | 4/2017 |
| KR | 20170001222 | U | 4/2017 |
| KR | 101761297 | B1 | 7/2017 |
| KR | 20170084313 | A | 7/2017 |
| KR | 101768582 | B1 | 8/2017 |
| KR | 101771206 | B1 | 8/2017 |
| KR | 20170095961 | A | 8/2017 |
| KR | 20170105099 | A | 9/2017 |
| KR | 20170105100 | A | 9/2017 |
| KR | 20170139700 | A | 12/2017 |
| KR | 101814567 | B1 | 1/2018 |
| KR | 101817701 | B1 | 1/2018 |
| KR | 20180010248 | A | 1/2018 |
| KR | 20180017193 | A | 2/2018 |
| KR | 20180017194 | A | 2/2018 |
| KR | 20180017196 | A | 2/2018 |
| KR | 20180017197 | A | 2/2018 |
| KR | 20180030620 | A | 3/2018 |
| KR | 101844912 | B1 | 4/2018 |
| KR | 20180033312 | A | 4/2018 |
| KR | 101855222 | B1 | 5/2018 |
| KR | 101855223 | B1 | 5/2018 |
| KR | 101861140 | B1 | 5/2018 |
| KR | 20180069051 | A | 6/2018 |
| KR | 20180069894 | A | 6/2018 |
| KR | 20180071986 | A | 6/2018 |
| KR | 20180072754 | A | 6/2018 |
| KR | 20180086444 | A | 7/2018 |
| KR | 101900840 | B1 | 9/2018 |
| KR | 20180105275 | A | 9/2018 |
| KR | 101906844 | B1 | 10/2018 |
| KR | 101909949 | B1 | 10/2018 |
| KR | 20180110243 | A | 10/2018 |
| KR | 101921159 | B1 | 11/2018 |
| KR | 20180003187 | U | 11/2018 |
| KR | 20180003188 | U | 11/2018 |
| KR | 20180003197 | U | 11/2018 |
| KR | 20180120253 | A | 11/2018 |
| KR | 20180120254 | A | 11/2018 |
| KR | 20180120815 | A | 11/2018 |
| KR | 20180121607 | A | 11/2018 |
| KR | 20180121984 | A | 11/2018 |
| KR | 20180124165 | A | 11/2018 |
| KR | 20180128480 | A | 12/2018 |
| KR | 101946431 | B1 | 2/2019 |
| KR | 101949900 | B1 | 2/2019 |
| KR | 20190017075 | A | 2/2019 |
| KR | 101953713 | B1 | 3/2019 |
| KR | 101953714 | B1 | 3/2019 |
| KR | 101963674 | B1 | 3/2019 |
| KR | 101964103 | B1 | 4/2019 |
| KR | 101965272 | B1 | 4/2019 |
| KR | 20190037328 | A | 4/2019 |
| KR | 20190038930 | A | 4/2019 |
| KR | 20190040108 | A | 4/2019 |
| KR | 101953711 | B1 | 5/2019 |
| KR | 101978707 | B1 | 5/2019 |
| KR | 101983111 | B1 | 5/2019 |
| KR | 20190001036 | U | 5/2019 |
| KR | 101990944 | B1 | 6/2019 |
| KR | 101992734 | B1 | 6/2019 |
| KR | 102007214 | B1 | 8/2019 |
| KR | 102007215 | B1 | 8/2019 |
| KR | 102007355 | B1 | 8/2019 |
| KR | 200489784 | Y1 | 8/2019 |
| KR | 20190090682 | A | 8/2019 |
| KR | 102018622 | B1 | 9/2019 |
| KR | 102018623 | B1 | 9/2019 |
| KR | 102010940 | B1 | 10/2019 |
| KR | 102030102 | B1 | 10/2019 |
| KR | 102030103 | B1 | 10/2019 |
| KR | 102031600 | B1 | 10/2019 |
| KR | 20190122864 | A | 10/2019 |
| KR | 102023273 | B1 | 11/2019 |
| KR | 102041173 | B1 | 11/2019 |
| KR | 20190126159 | A | 11/2019 |
| KR | 20190141227 | A | 12/2019 |
| KR | 200490784 | Y1 | 1/2020 |
| KR | 102074285 | B1 | 2/2020 |
| KR | 200491247 | Y1 | 3/2020 |
| KR | 102101642 | B1 | 4/2020 |
| KR | 102101643 | B1 | 4/2020 |
| KR | 102102243 | B1 | 4/2020 |
| KR | 102121904 | B1 | 6/2020 |
| KR | 20200068710 | A | 6/2020 |
| KR | 102143436 | B1 | 8/2020 |
| KR | 102158115 | B1 | 9/2020 |
| KR | 102175883 | B1 | 11/2020 |
| KR | 102179911 | B1 | 11/2020 |
| KR | 102210212 | B1 | 1/2021 |
| KR | 20210012063 | A | 2/2021 |
| KR | 102270980 | B1 | 6/2021 |
| KR | 102270981 | B1 | 6/2021 |
| KR | 20210080545 | A | 6/2021 |
| KR | 102319738 | B1 | 11/2021 |
| KR | 102319796 | B1 | 11/2021 |
| KR | 102328006 | B1 | 11/2021 |
| KR | 102336278 | B1 | 12/2021 |
| KR | 20210156324 | A | 12/2021 |
| KR | 102349191 | B1 | 1/2022 |
| KR | 102383039 | B1 | 4/2022 |
| WO | 2009077747 | A3 | 10/2009 |
| WO | 2011078593 | A3 | 11/2011 |
| WO | 2012028862 | A1 | 3/2012 |
| WO | 2012080751 | A3 | 9/2012 |
| WO | 2013016583 | A1 | 1/2013 |
| WO | 2013144569 | A1 | 10/2013 |
| WO | 2013144570 | A1 | 10/2013 |
| WO | 2013144571 | A1 | 10/2013 |
| WO | 2013144572 | A1 | 10/2013 |
| WO | 2013144574 | A1 | 10/2013 |
| WO | 2013144575 | A1 | 10/2013 |
| WO | 2013144576 | A1 | 10/2013 |
| WO | 2013171732 | A1 | 11/2013 |
| WO | 2013171750 | A1 | 11/2013 |
| WO | 2014006365 | A1 | 1/2014 |
| WO | 2014006366 | A1 | 1/2014 |
| WO | 2014001770 | A3 | 3/2014 |
| WO | 2014147460 | A8 | 11/2014 |
| WO | 2014201424 | A1 | 12/2014 |
| WO | 2015001303 | A1 | 1/2015 |
| WO | 2015001304 | A1 | 1/2015 |
| WO | 2015001305 | A1 | 1/2015 |

(56) References Cited

FOREIGN PATENT DOCUMENTS

| | | | |
|---|---|---|---|
| WO | 2015001306 | A1 | 1/2015 |
| WO | 2015001307 | A1 | 1/2015 |
| WO | 2015001308 | A1 | 1/2015 |
| WO | 2015001310 | A1 | 1/2015 |
| WO | 2015008024 | A1 | 1/2015 |
| WO | 2015011442 | A1 | 1/2015 |
| WO | 2015044644 | A1 | 4/2015 |
| WO | 2015044645 | A1 | 4/2015 |
| WO | 2015087040 | A1 | 6/2015 |
| WO | 2015087043 | A1 | 6/2015 |
| WO | 2015008025 | A3 | 7/2015 |
| WO | 2015140506 | A1 | 9/2015 |
| WO | 2015140507 | A1 | 9/2015 |
| WO | 2015140508 | A1 | 9/2015 |
| WO | 2016072657 | A1 | 5/2016 |
| WO | 2016097682 | A1 | 6/2016 |
| WO | 2016097683 | A1 | 6/2016 |
| WO | 2016113523 | A1 | 7/2016 |
| WO | 2016116728 | A1 | 7/2016 |
| WO | 2016116729 | A1 | 7/2016 |
| WO | 2016189270 | A1 | 12/2016 |
| WO | 2016196916 | A1 | 12/2016 |
| WO | 2016203195 | A1 | 12/2016 |
| WO | 2016203196 | A1 | 12/2016 |
| WO | 2016203197 | A1 | 12/2016 |
| WO | 2016203198 | A1 | 12/2016 |
| WO | 2017009595 | A1 | 1/2017 |
| WO | 2017016865 | A1 | 2/2017 |
| WO | 2017068320 | A1 | 4/2017 |
| WO | 2017068321 | A1 | 4/2017 |
| WO | 2017068322 | A1 | 4/2017 |
| WO | 2017098200 | A1 | 6/2017 |
| WO | 2017098204 | A1 | 6/2017 |
| WO | 2017163003 | A1 | 9/2017 |
| WO | 2017163005 | A1 | 9/2017 |
| WO | 2017163007 | A1 | 9/2017 |
| WO | 2017163066 | A1 | 9/2017 |
| WO | 2017163068 | A1 | 9/2017 |
| WO | 2017187128 | A3 | 12/2017 |
| WO | 2018042154 | A1 | 3/2018 |
| WO | 2018051059 | A1 | 3/2018 |
| WO | 2018051113 | A1 | 3/2018 |
| WO | 2018130798 | A1 | 7/2018 |
| WO | 2018130832 | A1 | 7/2018 |
| WO | 2018162878 | A1 | 9/2018 |
| WO | 2018172734 | A1 | 9/2018 |
| WO | 2018172735 | A1 | 9/2018 |
| WO | 2018206911 | A1 | 11/2018 |
| WO | 2019077301 | A1 | 4/2019 |
| WO | 2020008163 | A1 | 1/2020 |
| WO | 2020055436 | A1 | 3/2020 |
| WO | 2020055519 | A1 | 3/2020 |
| WO | 2020089579 | A1 | 5/2020 |
| WO | 2020257765 | A1 | 12/2020 |
| WO | 2021167652 | A1 | 8/2021 |
| WO | 2019067716 | A9 | 12/2021 |
| WO | 2022069857 | A1 | 4/2022 |
| WO | 2022069858 | A1 | 4/2022 |
| WO | 2022069859 | A1 | 4/2022 |
| WO | 2022069860 | A1 | 4/2022 |
| WO | 2022069864 | A1 | 4/2022 |
| WO | 2022069865 | A1 | 4/2022 |
| WO | 2022069881 | A1 | 4/2022 |
| WO | 2022162336 | A1 | 8/2022 |
| WO | 2022162337 | A1 | 8/2022 |
| WO | 2022162338 | A1 | 8/2022 |
| WO | 2022162339 | A1 | 8/2022 |
| WO | 2022162340 | A1 | 8/2022 |
| WO | 2023228014 | A1 | 11/2023 |

* cited by examiner

ATTACHMENT FOR HAIR CARE APPLIANCE

FIELD

Attachments are provided for use with hair care appliances.

BACKGROUND

Hair care appliances are devices used for drying and styling of hair. Hair care appliances can include a variety of components operable to provide a fluid flow via a fluid flow path extending through the device. The fluid flow path receives ambient air at an inlet of the hair care appliance and directs the ambient air through the hair care appliance via a motor and fan assembly. The fluid flow path is directed across a heating assembly to generate heated air at an outlet of the hair care appliance. Air is expelled from the hair care appliance via an outlet arranged to enable a user to dry or style hair.

One or more attachments are often used with the hair care appliance depending on the user's hair styling or treatment needs. Attachments can be coupled to the outlet of the hair care appliance and can be designed to perform specific functions on the hair.

SUMMARY

In general, an attachment configured for use with a hair care device, such as a hair dryer for use in drying and/or styling hair, is provided. In one aspect, an attachment for a hair care appliance is provided and includes a nozzle defining a first air flow path extending between a first air inlet and a first air outlet. The attachment can also include a cover coupled to the nozzle such that the cover and nozzle together define a second air flow path between a second air inlet and a second air outlet. The attachment can further include a hollow cylindrical barrel coupled to the nozzle and positioned to receive air flowing out of the first air outlet circumferentially there around. In some embodiments, the hollow cylindrical barrel can include a plurality of ribs extending around at least a portion of an outer circumference thereof and configured to direct the first air flow path around the at least a portion of the outer circumference of the hollow cylindrical barrel.

In one embodiment, the attachment can include a heating element positioned along at least a portion of the outer circumference of the hollow cylindrical barrel. The plurality of ribs can be interleaved with the heating element. In another embodiment, the plurality of ribs can extend radially away from the heating element.

In another embodiment, the nozzle can have a first substantially cylindrical portion defining the first air inlet configured to couple to an outlet end of a hair care appliance. The first substantially cylindrical portion can taper from a circumferential opening at the first air inlet to a linear opening at the first air outlet. In another embodiment, the nozzle can have a second hemi-cylindrical portion extending from the first substantially cylindrical portion and configured to guide air flow from the first substantially cylindrical portion along a hemi-circumferential path.

In another embodiment, the second air flow path can include at least one opening formed in the cover and open to an ambient environment surrounding the cover. In some embodiments, the first air outlet can be positioned between the hollow barrel assembly and nozzle. In another embodiment, the first and second air outlets can extend substantially parallel to one another.

In another embodiment, the cover can include a first cover portion positioned on a first side of the frame and defining the second air inlet, and a second cover portion positioned on a second side of the frame and coupled to the first cover portion. In some embodiments, a terminal end of the cover adjacent the second air outlet can be non-linear, such as scalloped.

In another aspect, an attachment for a hair care appliance is provided and includes a body assembly having a frame and a cover surrounding at least a portion of the frame. The frame can have an inner lumen therein forming a primary air flow path between a primary air inlet at a first end of the body and a primary air outlet at a second end of the body opposite the first end. The attachment can also include a heat transfer assembly including a cylindrical barrel coupled to the frame such that at least a portion of the cover extends around the cylindrical barrel. In some aspects, the heat transfer assembly can include a conductive insert disposed on the cylindrical barrel. In other aspects, the cylindrical barrel can have a plurality of projections extending radially outward therefrom and at least partially circumferentially around the barrel and through the conductive insert.

In some aspects, the conductive insert can be positioned within a recessed portion of the cylindrical barrel and can extend around at least a portion of a circumference of the cylindrical barrel. The conductive insert can include or be formed from various materials, for example it can be formed from or include a ceramic coating thereon configured to retain and distribute heat across the conductive insert. In use, the conductive insert can be configured to receive heat via heated air provided from the primary air outlet.

In another embodiment, the cover and the frame can define a secondary air flow path between a secondary air inlet at the first end of the body and a secondary air outlet at the second end of the body.

In another aspect, an attachment for a hair care appliance is provided and includes a nozzle having a first flow path extending there through between a first air inlet at a first end and a first air outlet at a second end. The attachment can also include a cover disposed over a portion of the nozzle such that the cover and nozzle define a second flow path extending between a second air inlet at the first end and a second air outlet at the second end. The cover can have a scalloped portion extending along a length thereof adjacent the second air outlet. The attachment can also include a hollow cylindrical barrel coupled to the nozzle and positioned adjacent the first and second air outlets such that air flowing from the first air outlet can flow circumferentially around the hollow cylindrical barrel.

In some embodiments, the scalloped portion can be formed from or can include a silicon material. In other embodiments, the scalloped portion can be formed along a terminal edge of a hemi-cylindrical portion of the cover.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary attachments or accessories for use with a hair care appliance, such as a hair dryer, are provided herein. In one embodiment, an attachment in the form of a hair polishing accessory is provided. The polishing attachment can be configured to efficiently engage with hair to smooth an uneven texture of hair, reduce hair frizz, and improve hair shine. The polishing attachment can include one or more features to aid in polishing. For example, the polishing attachment can include a heated surface configured to transfer heat to hair to make the hair more pliable for smoothing, reducing frizz, and improving hair shine. The polishing attachment can also include ribs extending around a cylindrical portion of the polishing attachment. The ribs can be configured to protect a user's scalp or fingers from contacting the heated surface and guide airflow around the cylindrical portion of the polishing attachment. The polishing attachment can further include a scalloped portion adjacent to a location at which hair is engaged by the polishing attachment. The scalloped portion can include or be formed from a friction-enhancing material, such as silicone, to allow the scalloped portion to create tension on hair and to provide improved control and intuitive use of the polishing attachment. Advantageously, these features can provide an enhanced styling experience, particularly for smoothing, straightening, reducing frizz, and improving the shine of a user's hair compared to other attachments for a hair care appliance.

Figure 1:
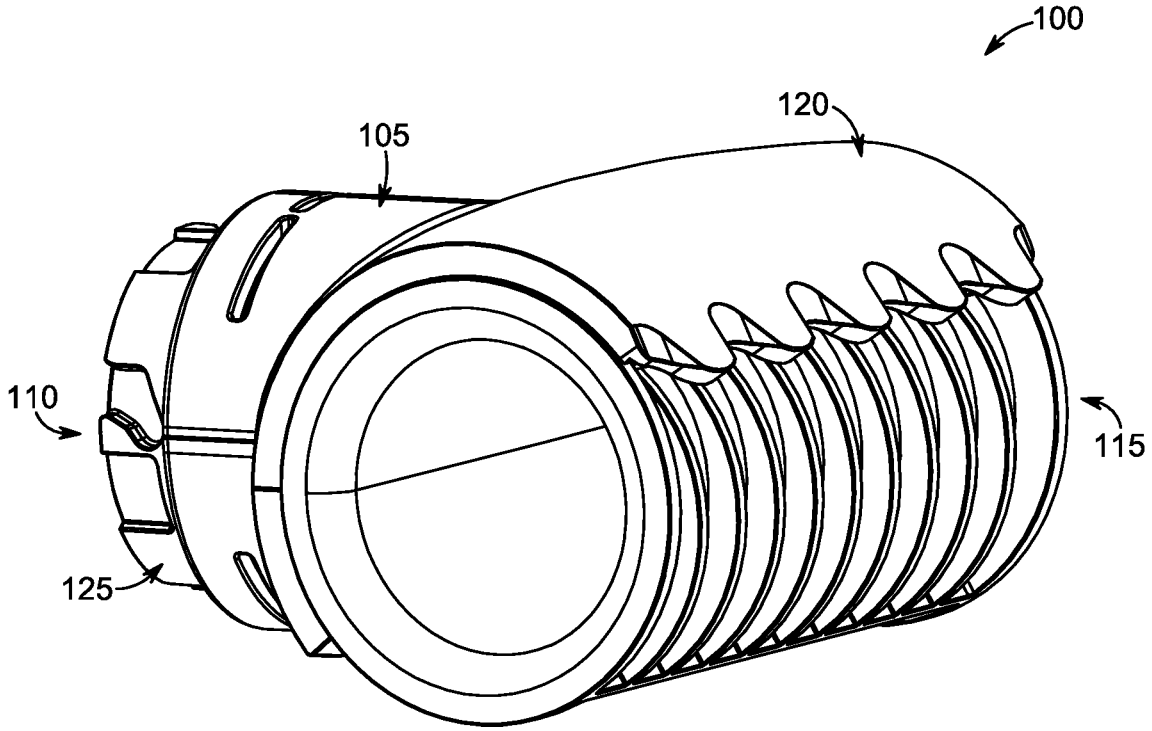
FIG. 1 is a front-side perspective view of one exemplary embodiment of a polishing attachment configured for use with a hair care appliance.
Figure 2:
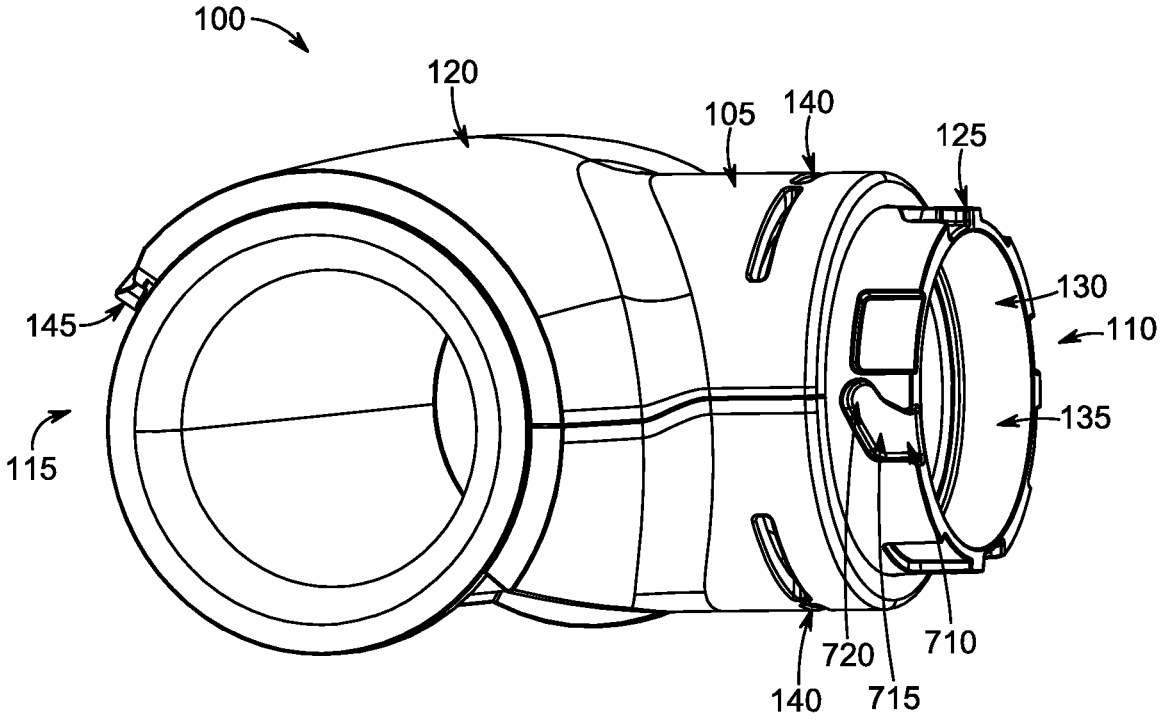
FIG. 2 is a rear-side perspective view of the polishing attachment of FIG. 1.
Figure 3:
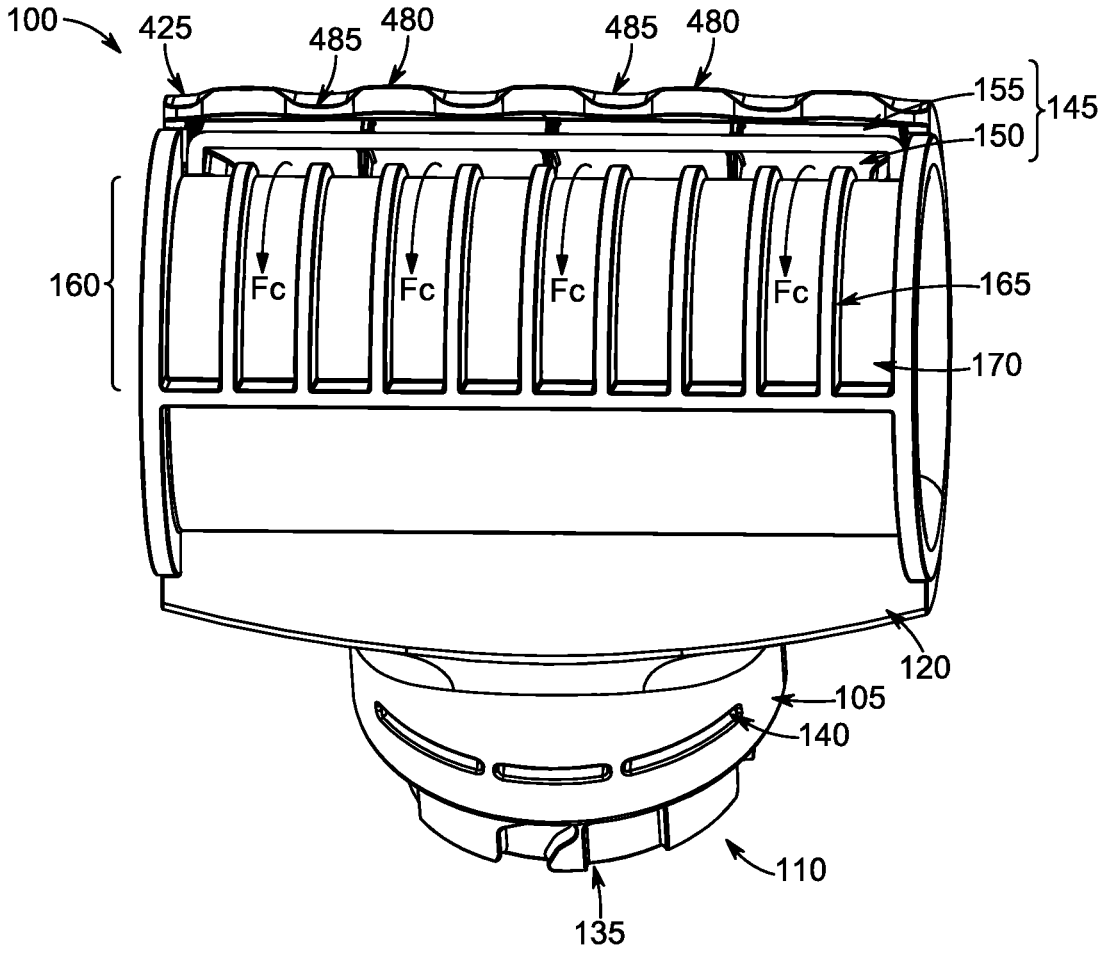
FIG. 3 is a bottom perspective view of the polishing attachment of FIG. 1.

FIGS. 1-3 illustrate one exemplary embodiment of an attachment 100. In this embodiment, the attachment 100 is in the form of a polishing attachment, however a person skilled in the art will appreciate that the features shown in the figures can be utilized in various other types of attachments, such as straighteners, or curlers. As shown in FIG. 1, the brush attachment 100 is substantially "T"-shape and includes a first cylindrical body 105 extending from a proximal end 110 toward a distal end 115 of the attachment 100. The first body 105 can form a nozzle through which air is received via an inlet and is provided via one or more outlets. A second cylindrical body 120 can be arranged transversely to the first body 105 at the distal end 115. The proximal end 115 can include an mating mechanism 125 configured to mate the attachment 100 with a hair care appliance, such as a hair dryer.

As indicated above, the first body 105 can include an opening 130 at the proximal end 110 defining a first air inlet 135, as shown in FIG. 2. The first air inlet 135 can receive air from the hair care appliance when the attachment 100 is coupled to the hair care appliance via the mating mechanism 125. As further shown in FIG. 2, one or more second air inlets 140 can be provided on the first body 105 at the proximal end 115. The air inlets 135, 140 can be fluidically coupled with one or more air outlets 145 at the distal end 115 along a fluid flow path extending through the attachment 100. As shown in FIG. 3, the air outlets 145 include first air outlets 150 and second air outlets 155. The first air outlets 150 and the second air outlets 155 can extend across a length of the second body 120 at the distal end 115 and can provide outlets for separate air flow paths extending through the first body 105. As will be described in more detail later, the first air inlet 135 can be fluidically coupled to the first air outlets 150 via a first air flow path and the second air inlets 140 can be fluidically coupled to the second air outlets 155 via a second air flow path. The air outlets 145 (referring collectively to the first air outlets 150 and the second air outlets 155) can provide a combined air flow FC across a circumferential portion 160 of the second body 120. The second body 120 can also include a plurality of ribs 165 extending from a surface of the second body 120 and a heating element 170 thereon. The air flow FC can be directed across the heating element 170 via the ribs 165.

Figure 4:
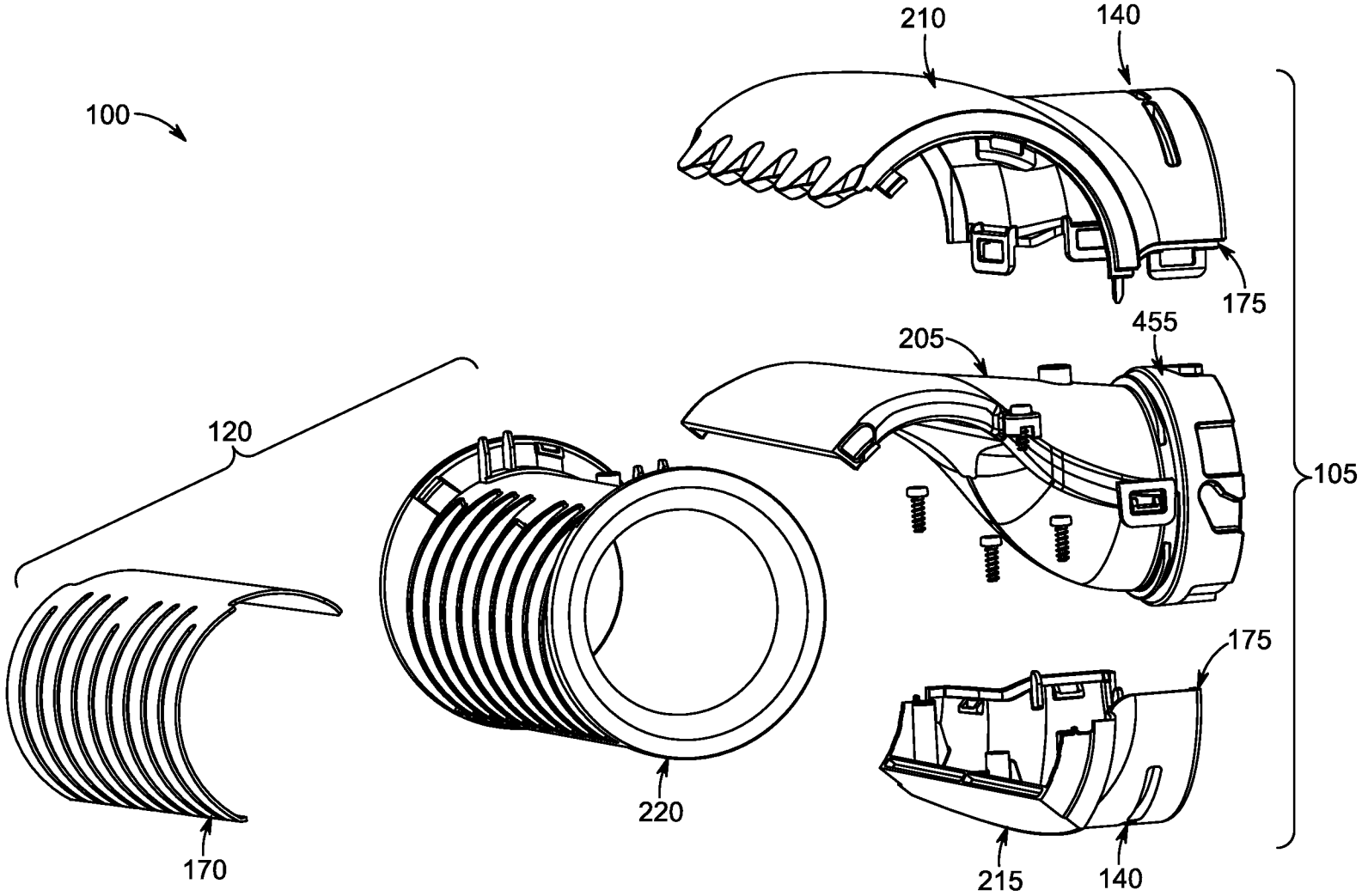
FIG. 4 is an exploded perspective view of the polishing attachment of FIG. 1, showing a frame, a cover with first and second portions, a barrel, and a heating element.

As shown in the exploded view of FIG. 4, the first body 105 of the attachment 100 can include a frame 205, a cover 175 having upper and lower cover portions 210, 215 surrounding the frame 205, and a hollow barrel 220. Although the frame 205 is shown to be enclosed by the upper cover 210 and the lower cover 215, in some embodiments the frame 205 can be enclosed by a single cover or only the upper cover 210 can be provided. The hollow barrel 220 can be coupled to the frame 205 and to the lower cover 215 via one or more attachment mechanisms, such as fasteners, a friction fit, snap fit, rivets, welding, or the like.

Figure 5:
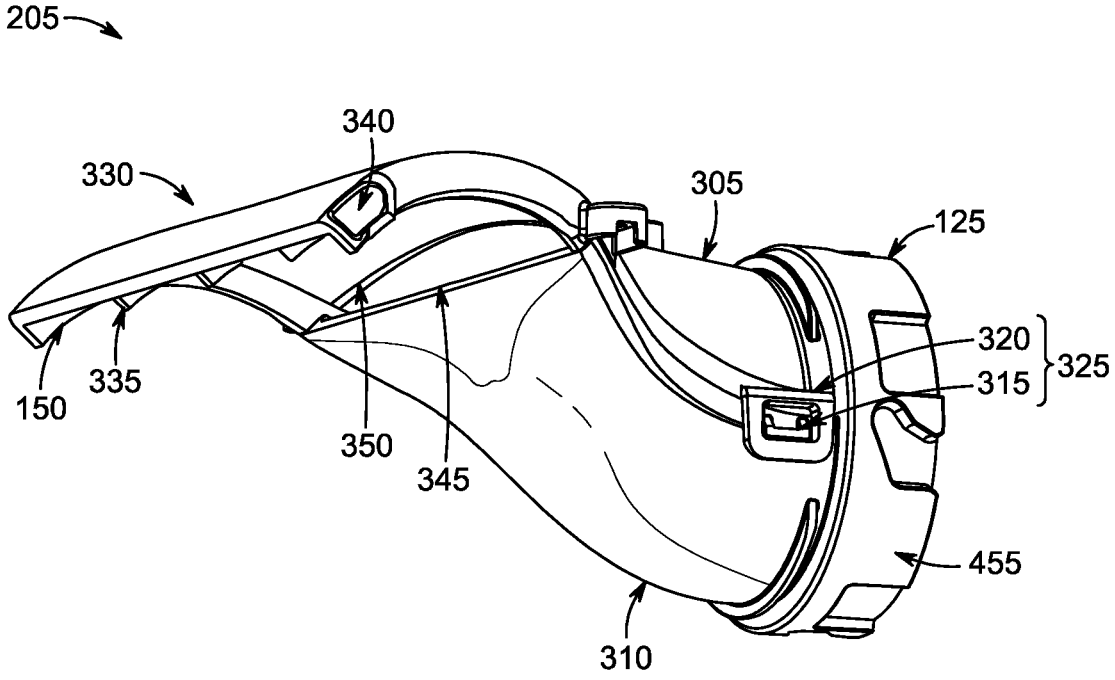
FIG. 5 is a front-side perspective view of the frame of FIG. 4.

As indicated above, the frame 205 can define a primary air path through the polisher attachment 100. The frame 205 can have a variety of configurations to allow air flow there through. The frame 205 can have a substantially cylindrical end at which the air inlet 135 is provided and can taper or otherwise transition to a substantially curved planar portion or end at which the first air outlets 150 are provided. In the illustrated embodiment, shown in more detail in FIG. 5, the frame 205 has a hollow elongate configuration with an upper portion 305 coupled with a lower portion 310. For example, as shown in FIG. 5, the upper portion 305 and the lower portion 310 that can be coupled together within the mating mechanism 125. Additionally the frame 205 can include one or more attachment mechanisms 325 configured to join the upper portion 305 to the lower portion 310 or vice versa. The illustrated attachment mechanism 325 includes a tab or protrusion 315 that is received within an engagement element 320 configured to secure the protrusion 315 therein. The attachment mechanisms 325 are positioned on opposed sides and along adjoining edges of exterior surfaces of the upper portion 305 and the lower portion 310, although alternate locations can be envisioned, such as along adjoining interior surfaces of the upper and lower portions. In some embodiments, the frame 205 can include a single unibody construction in place of upper and lower portions.

The upper portion 305 can have a substantially semi-circular proximal end at which it is received within the mating mechanism 125 and an arcuate or curved distal end 330 that can be configured to match the curvature or circumference of the barrel 220, discussed further below. The upper portion 305 can also include one or more projections 335 extending from an inferior surface of the upper portion 305 toward the barrel 220. The projections 335 can be configured so that the first air outlets 150 are provided there between. The upper portion 305 can further include tabs 340 located on opposing edges at the distal end 330 of the upper cover 305. The tabs 340 can be received within corresponding cavities or receiving portions of a side wall of the upper cover 210, discussed below. In this way, the upper cover 210 can be secured to the upper portion 305 of the frame 205 at the distal end 115 of the attachment 100.

Figure 6:
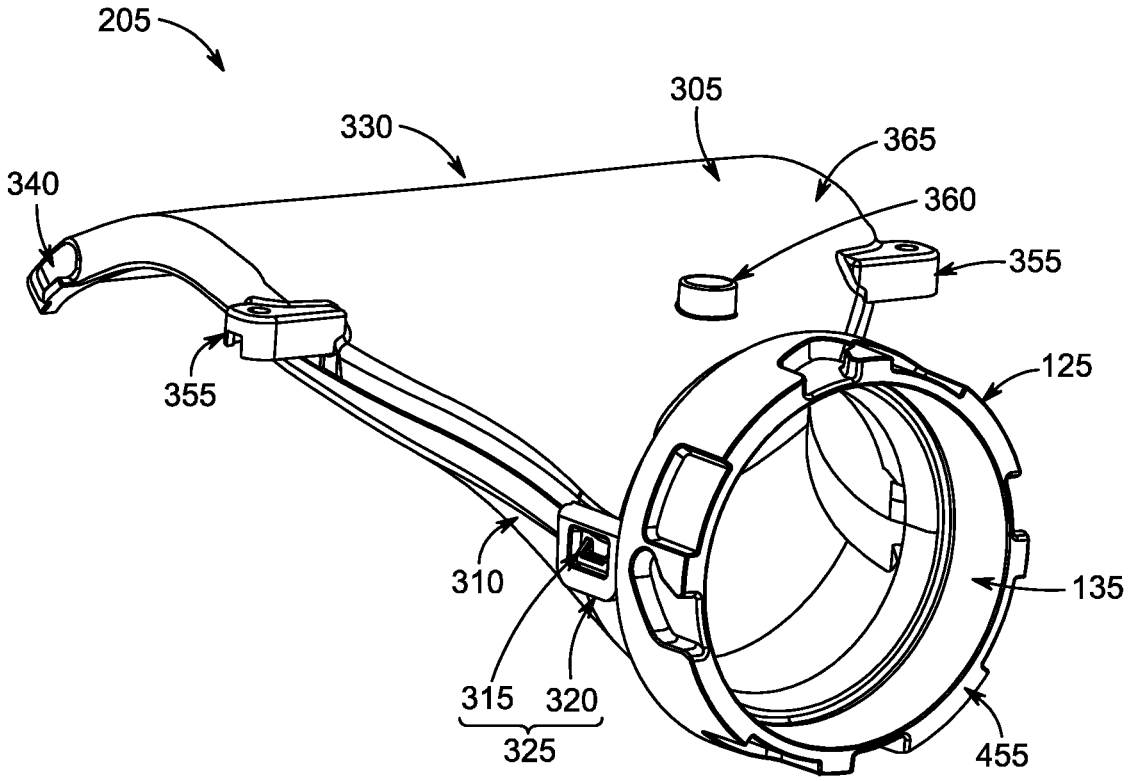
FIG. 6 is a rear-side perspective view of the frame of FIG. 5.

The frame 205 can further include features to aid in attachment to the barrel 220, discussed further below. As shown in FIG. 6, the upper portion 305 can include one or more projections 355. The projections 355 can be configured to receive an attachment mechanism, such as a screw, to couple the upper portion 305 with corresponding receiving portions on the hollow barrel 220. In some embodiments, a variety of attachment mechanisms can be envisioned including friction fit, snap fit, rivets, or the like and may not require projections 355 to secure the upper portion 305 to the hollow barrel 220. As shown in FIG. 6, the upper portion 305 can also include a projection 360 configured to maintain a gap or distance between the upper surface 365 of the upper portion 305 and the upper cover 210 when coupled together. The gap or distance created by the projection 360 can have a size that dictates a height of the outlets 155 (shown in FIG. 3) which are formed between an inferior surface of the upper cover 210 and the upper surface 365 of the upper portion 305.

As further shown in FIG. 5, the lower portion 310 can also have a substantially semi-circular proximal end at which is received within the mating mechanism 125 and an arcuate or curved distal end 345. The curved distal end 345 can have a length that is shorter than a length of the distal end 330 of the upper portion 305, such that the bottom surface of upper portion 305 is exposed. An opening 350 can be formed between the upper portion 305 and the lower portion 310 to allow air flow from the air inlet 135 to flow toward the first air outlets 150. As discussed further below, the extended length of the upper portion 305 can allow the upper portion 305 to extend over a portion of the hollow barrel 220 to define a fluid flow path there between. As a result, the air flow from the air inlet 135 can be guided to the first air outlets 150 between the curved inferior surface of the upper portion 305 and the curved exterior surface of the hollow barrel 220.

As indicated above, the polisher attachment 100 further includes a cover 175 disposed over the frame 205. The cover 175 can include an upper cover 210 and a lower cover 215. In some embodiments, the cover 175 can be a single cover having a unibody construction in place of upper and lower covers 210, 215.

Figure 16:
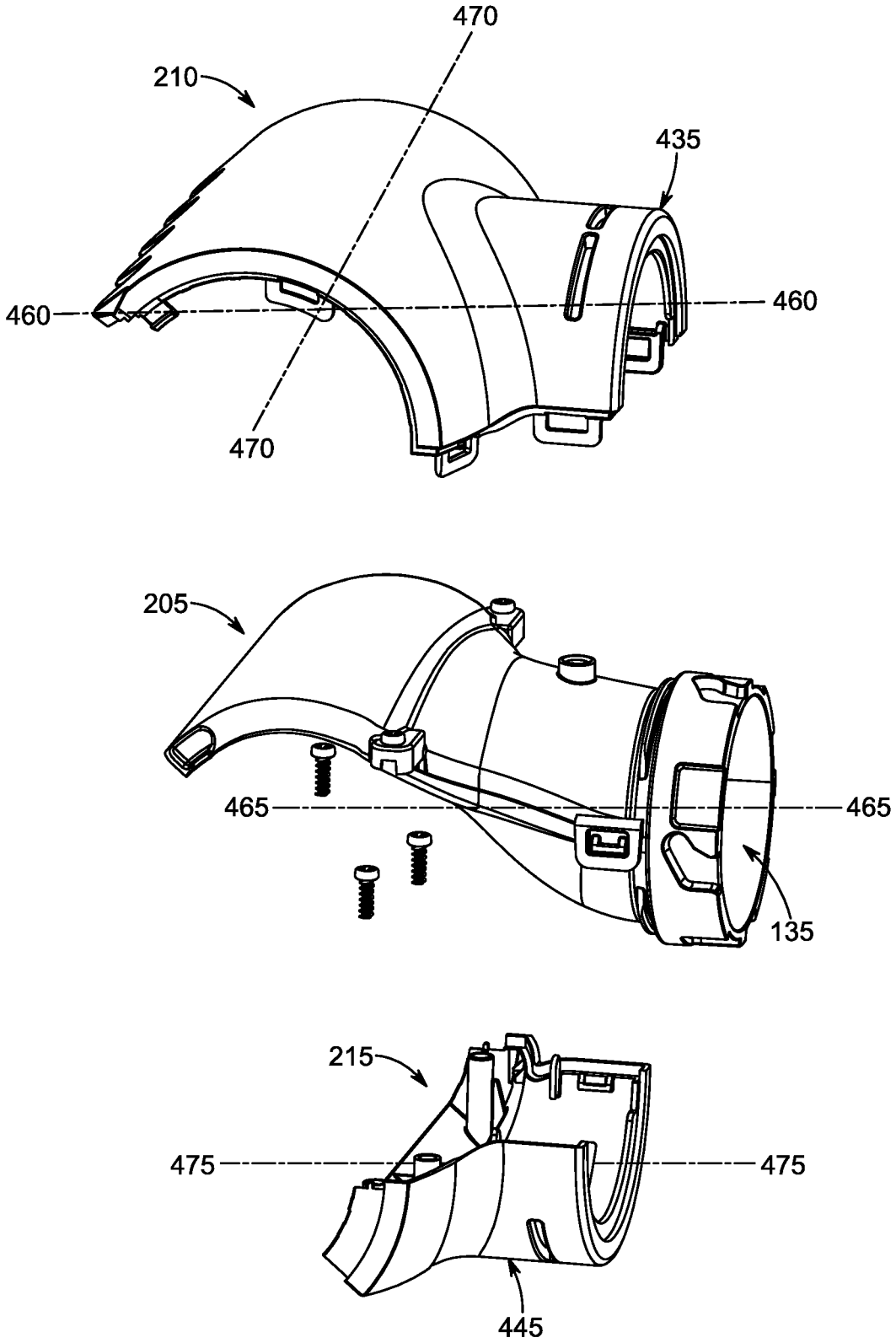
FIG. 16 is another exploded view of the frame and cover of FIG. 4.

The shape of the cover 175 can vary, but in an exemplary embodiment the upper and lower covers 210, 215 each have a hemi-cylindrical portion that together define a cylindrical housing configured to fit around the cylindrical portion of the frame 205. The upper cover 210 includes a first hemi-cylindrical portion 435 extending from the mating mechanism 125. As shown in FIG. 16, the first hemi-cylindrical portion 435 can having a central axis 460 that is oriented co-axial with a longitudinal axis 465 extending through the air inlet 135. The first hemi-cylindrical portion 435 can transition to a second hemi-cylindrical portion 440 of the upper cover 210 that can be oriented along a central axis 470 that extends transverse, e.g., perpendicular, to the longitudinal axis extending through the air inlet 135. Thus, the upper cover 210 can have a "T"-shape. The second hemi-cylindrical portion 440 of the upper cover 210 can have a curvature that can correspond to a curvature of the distal end 330 of the frame 205 and a curvature of the hollow barrel 220.

Figure 8:
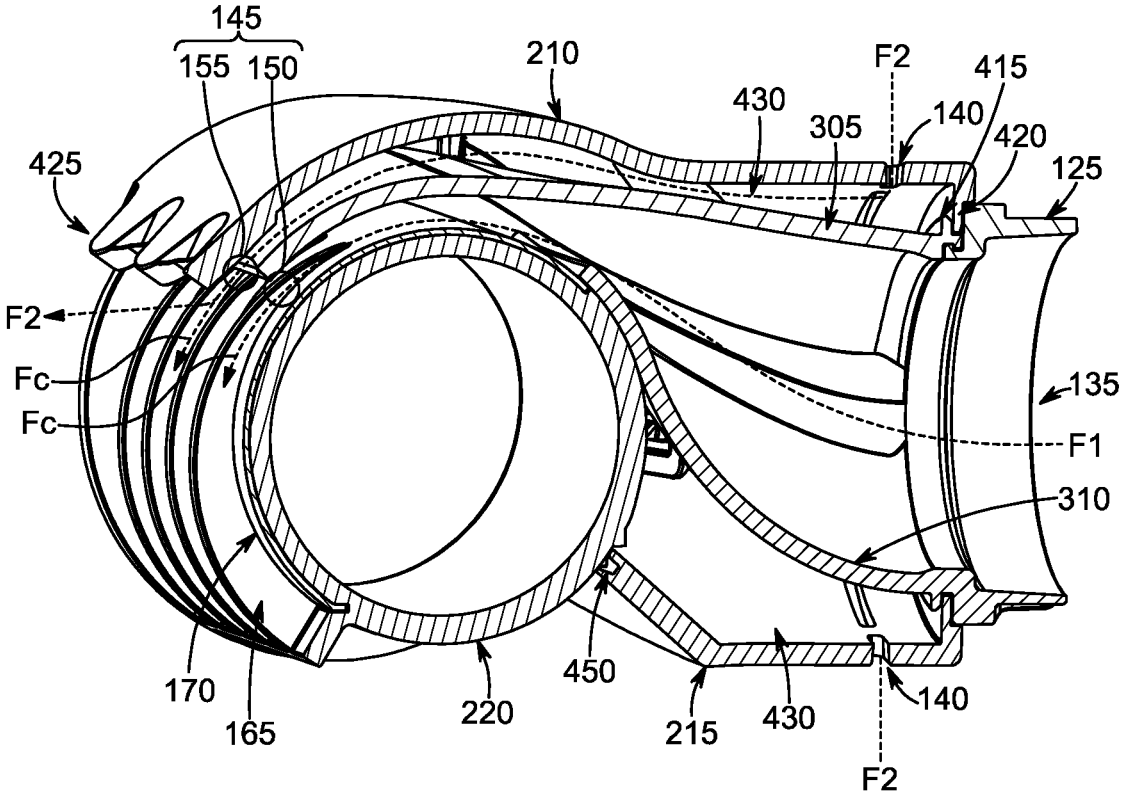
FIG. 8 is a cross-sectional view of the polishing attachment of FIG. 1 illustrating air flow therein.

As further shown in FIG. 16, the lower cover 215 can also have a first hemi-cylindrical portion 445 having a central axis 475 that is oriented co-axially with respect to a longitudinal axis extending through the air inlet 135. The lower cover 215 can also have a linear edge 450 that extends across the lower cover 215 transversely, e.g., perpendicular, to the first hemi-cylindrical portion 445 and the longitudinal axis extending through the air inlet 135. The linear edge 450 can be configured to abut a portion of the hollow barrel 220, as shown in FIG. 8, to thereby form a seal against the hollow barrel.

Figure 7:
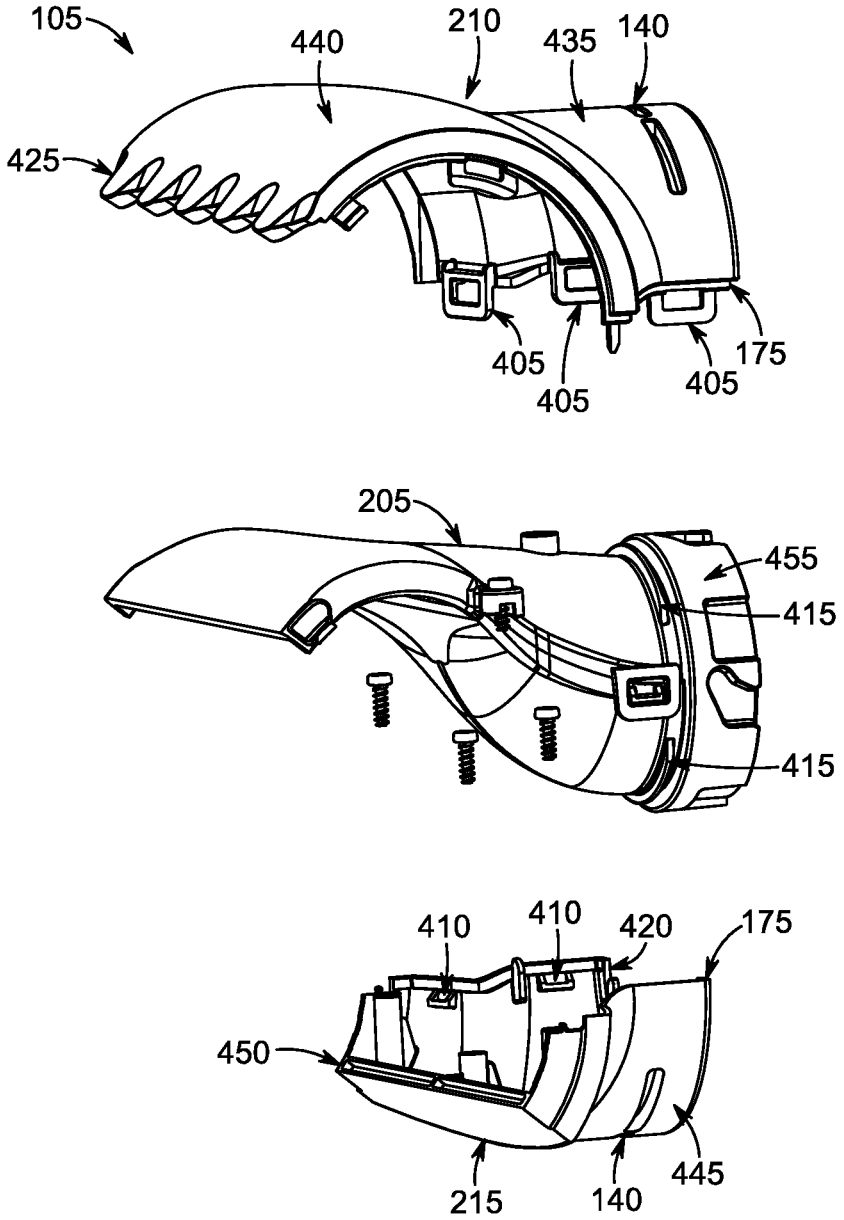
FIG. 7 is an exploded perspective view of the frame and cover of FIG. 4.

In the exploded view of FIG. 7, the illustrated cover 175 includes one or more attachment mechanisms 405 and 410 configured to join the upper cover 210 to the lower cover 215 or vice versa. For example, as shown in FIG. 7, the upper cover 210 includes an engagement element 405 projecting from a bottom edge of the upper cover 210 on an interior surface thereof. The engagement element 405 can receive a corresponding tab or protrusion 410 on the lower cover 215. The tab or protrusion 410 extends radially inward from an upper edge of the lower cover 215 on an inner surface thereof to be received within the engagement element 405 to thereby secure the protrusion 410 therein. The engagement element 405 and protrusion 410 can be positioned along adjoining edges of interior surfaces of the upper cover 210 and the lower cover 215, although alternate locations are envisioned, such as along adjoining exterior surfaces of the upper and lower covers.

In order to mount the cover 175 to the frame, the frame 205 can include a collar 415 extending radially around all or a portion of the proximal end of the frame 205 adjacent to the mating mechanism 125. The collar 415 can extend radially away from the outer surfaces of the upper portion 305 and the lower portion 310 toward inner surfaces of the upper and lower covers 210, 215. The collar 415 can be configured to engage with a corresponding collar 420 formed on an interior surface of the upper cover 210 and the lower cover 215 at the proximal end of the covers 210, 215 adjacent to the second air inlets 140. The collar 420 can be received within a groove formed between the collar 415 and the mating mechanism 125 as shown in FIG. 8.

When mated, the cover 175 can be sized with respect to the frame 205 such that a hollow space 430 is formed between the interior surfaces of the cover 175 and exterior surfaces of the frame 205. The upper and lower covers 210, 215 can include openings arranged at a proximal end of the cover 175. For example, the cover 175 can include the second air inlets 140. The illustrated second air inlets 140 are in the form of slots extending through the first hemi-cylindrical portion 435 and the second hemi-cylindrical portion 445. In some embodiments, the second air inlets 140 can have other shapes besides slots, such as circles, ovals, or the like. The second air inlets 140 can be in fluidic communication with the hollow space 430 and the second air outlets 155. The hollow space 430 can be seen above and below the frame 205 in the cross-sectional view of FIG. 8.

As previously explained, the upper cover 210 further include a second hemi-cylindrical portion 440 that is configured to extend over a portion of the barrel. As shown in FIG. 8, a terminal end of the second hemi-cylindrical portion 440 can extend linearly across an entire length of the hollow barrel 220 and the frame 205. In some embodiments, the upper cover 210 can have a non-linear terminal end, such as a scalloped portion 425 as shown in FIGS. 7 and 8. The scalloped portion 425 can extend across the distal end of the upper cover 210 and can have a length corresponding to a length of the hollow barrel 220. The scalloped portion 425 can form an upper surface of the second air outlets 155 and can direct the air flow F2 out of the second air outlets 155. In some embodiments, the scalloped portion 425 can include or can be formed from a high-friction material, such as silicone. In some embodiments, the scalloped portion 425 can be a separate component coupled with the upper cover 210, or the scalloped portion 425 can be integrally formed within the upper cover 210 or can be an insert that can be coupled to the second hemi-cylindrical portion 440. The scalloped portion 425 can be configured to engage with and create tension on a user's hair as the attachment 100 is drawn down from a location close to the user's scalp and over the length of the user's hair to polish, shine, and reduce frizz of their hair.

The air flow through the attachment 100 can be seen in FIGS. 3 and 8. As shown in FIG. 8, a first air flow path F1 can extend between the air inlet 135 and the first air outlets 150. The first air flow path F1 forms a primary airflow path that is provided within the frame 205 and exits the attachment 100 via the outlets 150 to pass over the exterior surface of the hollow barrel 220. A second air flow path F2 can extend between the air inlets 140 and the second air outlets 155. The second air flow path F2 can form a secondary airflow path that extends through a hollow space 430 formed between the upper cover 210, the lower cover 215 and the frame 205. The second air flow path F2 can exit via the attachment 100 via the second air outlets 155. The second air flow path F2 may mix entirely with the first air flow path F1. The scalloped portion 425 of the upper cover 210 can cause the first air flow path F1 and the second portion of the second air flow path F2 to combine and can direct the combined air flow path FC around the circumference of the hollow barrel 220. Thus, as the first air flow path F1 and the second portion of the second air flow path F2 exit respective outlets of the outlets 145, the air flow paths F1 and F2 are combined to form the combined air flow path FC. In other aspects, a first portion of the second air flow path F2 may flow radially away from the hollow barrel 220 and a second portion of the second air flow path F2 may mix with the first air flow path F1 to flow over the exterior surface of the hollow barrel 220.

The combined air flow path FC exiting the outlets 140 can provide a Coanda effect with respect to hair placed in proximity of the air flow. The Coanda effect is the tendency of a fluid flow to emerge from an opening, such as the outlets 140, and to follow an adjacent surface. Air from the surroundings can be entrained with the air flow exiting the outlets 140 so that a region of lower pressure is developed adjacent to the hollow barrel 220. Hair placed in proximity of the combined air flow path FC can be draw toward the curved surface of the hollow barrel 220.

Figure 9:
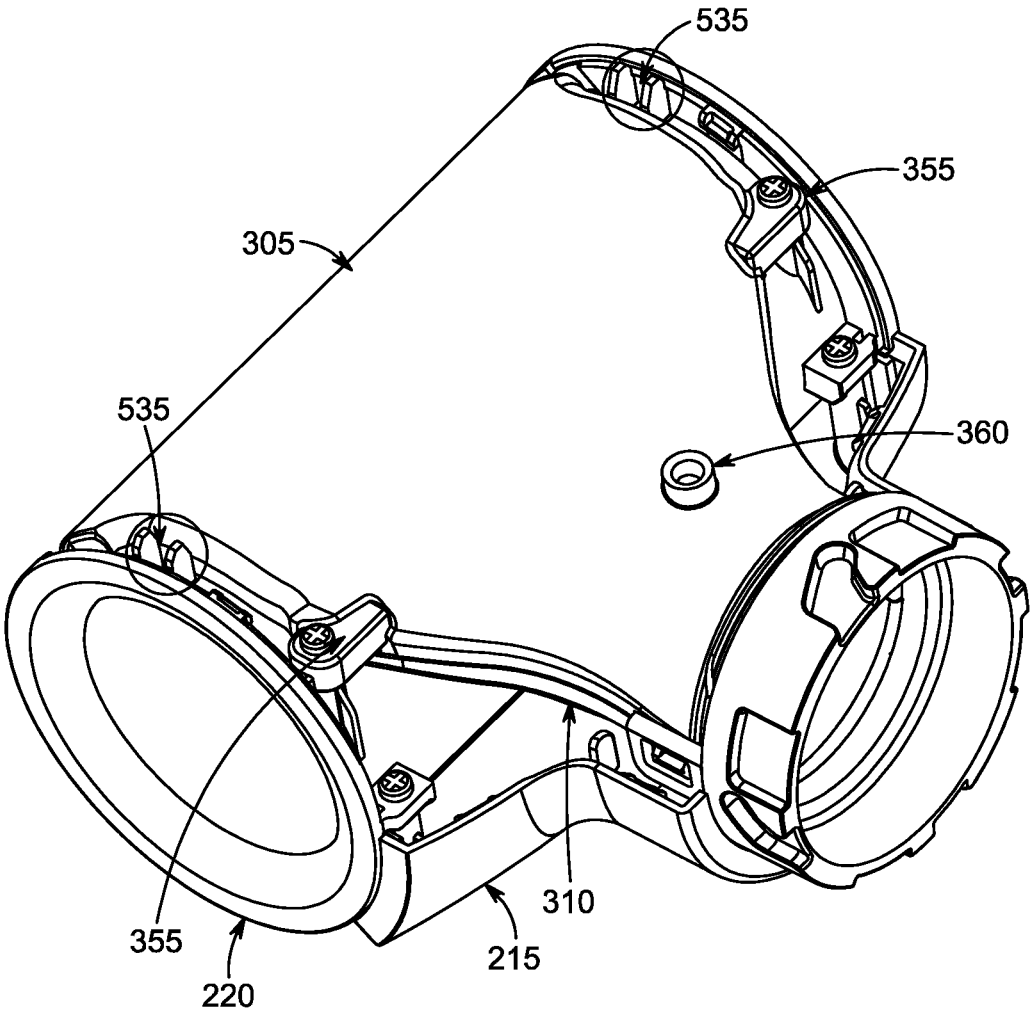
FIG. 9 is a top-rear perspective view of the polishing attachment of FIG. 1 with an upper cover removed.
Figure 10:
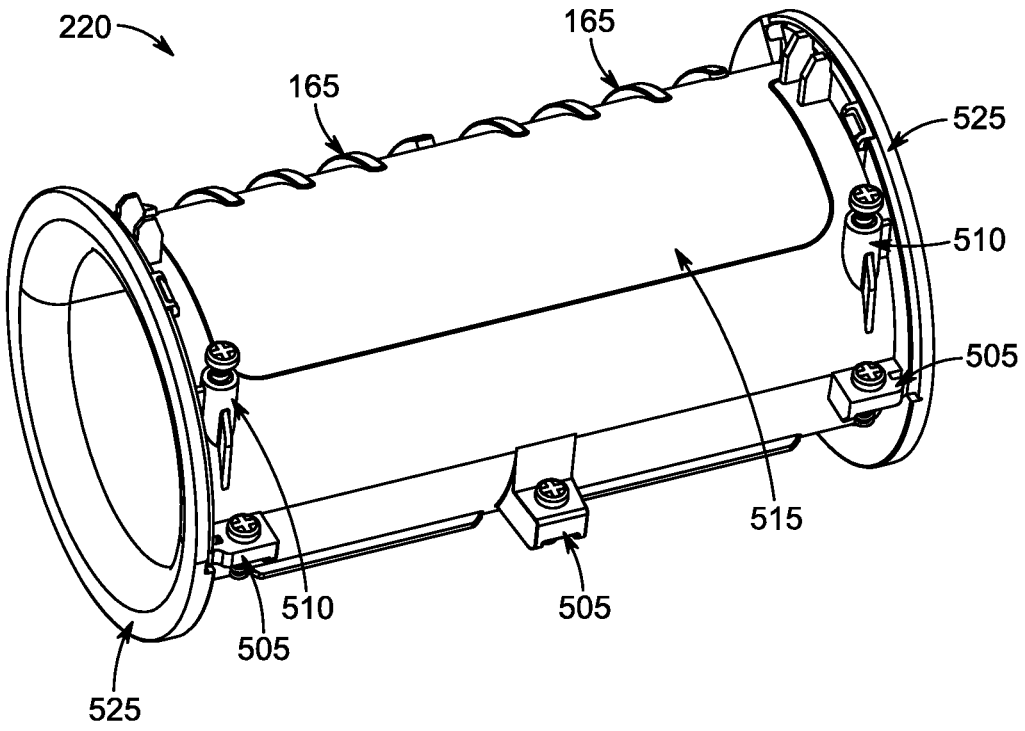
FIG. 10 is a top-rear perspective view of the barrel of FIG. 4 shown assembled.

FIG. 9 illustrates the hollow barrel 220, which can be coupled to the upper portion 305 and the lower portion 310 of the frame 205. The frame 205 can be arranged such that the opening 350 formed between the upper portion 305 and the lower portion 310 is adjacent with the exterior surface of a portion of the hollow barrel 220 and in fluidic communication with the first air outlets 150. While various mating techniques can be used to mate the barrel 220 to the frame 205, as shown in FIG. 10, the hollow barrel 220 can include projections 505 located on an exterior surface of the barrel 220. For example, the projections 505 can be arranged adjacent to opposed open ends of the barrel 220. The projections 505 can be configured as attachment mechanisms to couple the hollow barrel 220 with the lower portion 310 of the frame 205. The hollow barrel 220 can also include attachment receiving portions 510 which can receive an attachment mechanism, such as a screw, provided via the projections 355 of the upper portion 305 to secure the hollow barrel 220 to the upper portion 305.

Figure 11:
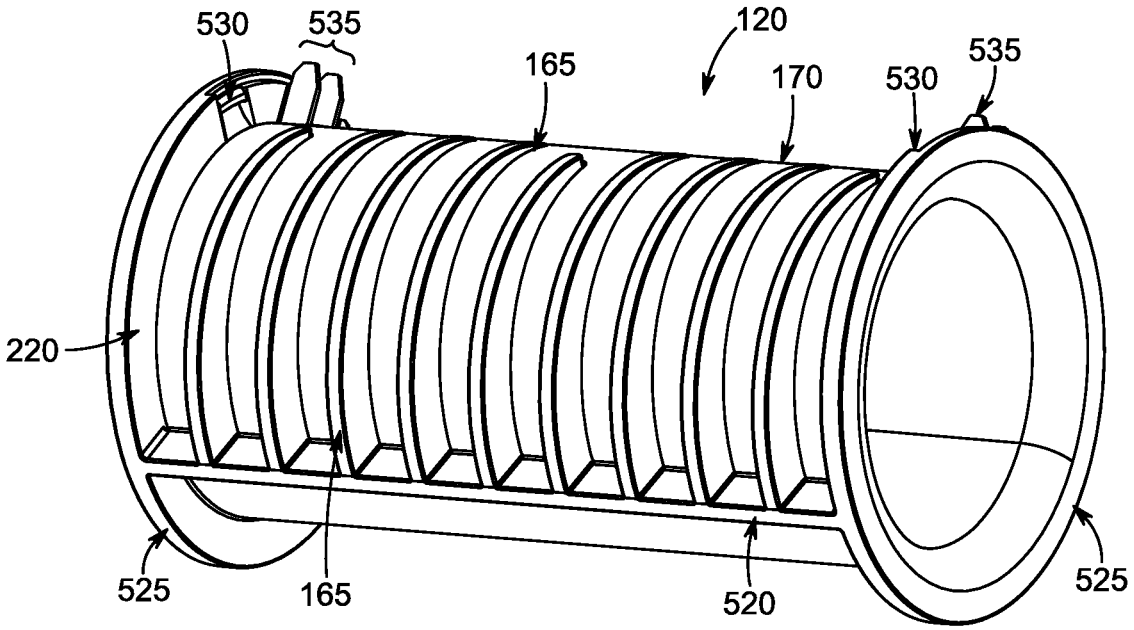
FIG. 11 is a front perspective view of the barrel and heating element of FIG. 4.
Figure 12:
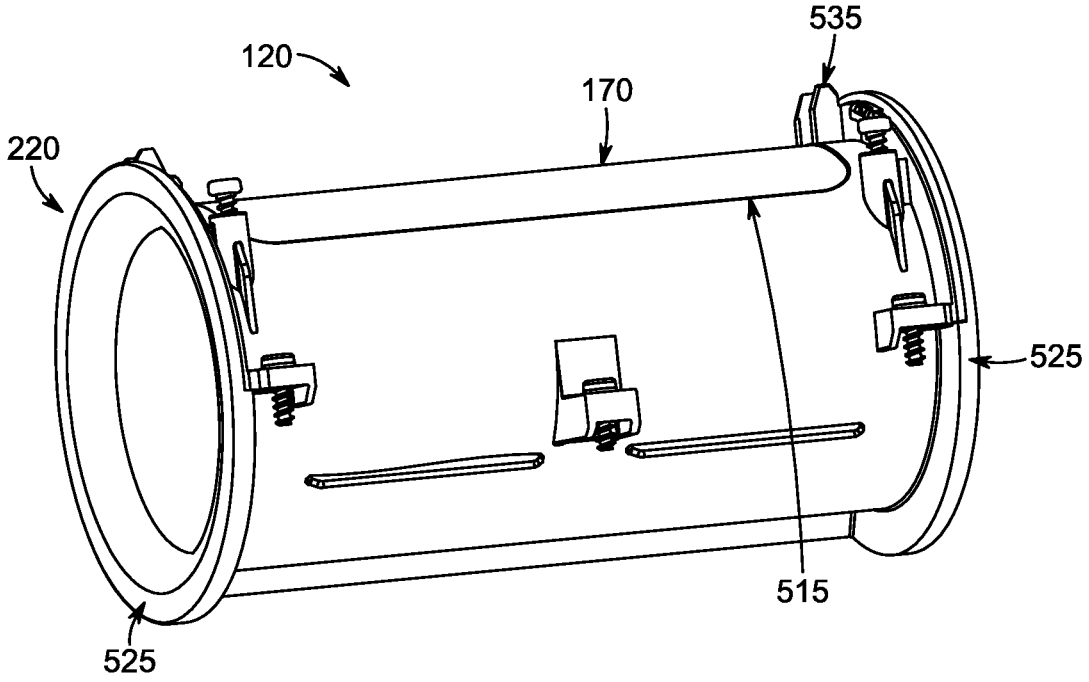
FIG. 12 is a rear perspective view of the barrel and heating element of FIG. 11.

With reference to FIGS. 10-12, the hollow barrel 220 can include a recessed portion 515 extending across a length of the hollow barrel 220 and around a circumferential portion of the barrel 220. The recessed portion 515 can extend between and along the length of the ribs 165 and over about half of the circumference of the barrel 220. In some embodiments, the recessed portion 515 can be extend over more or less than half of the circumference of the barrel 220. The ribs 165 can extend from a base wall 520 extending longitudinally along the hollow barrel 220 as shown in FIG. 11. The ribs 165 can have a height equal to a height of the base wall 520. The ribs 165 can have varying lengths extending away from the base wall 520 and can include shorter ribs disposed between longer ribs, although other non-limiting arrangements of the ribs 165 can be envisioned.

Figure 17:
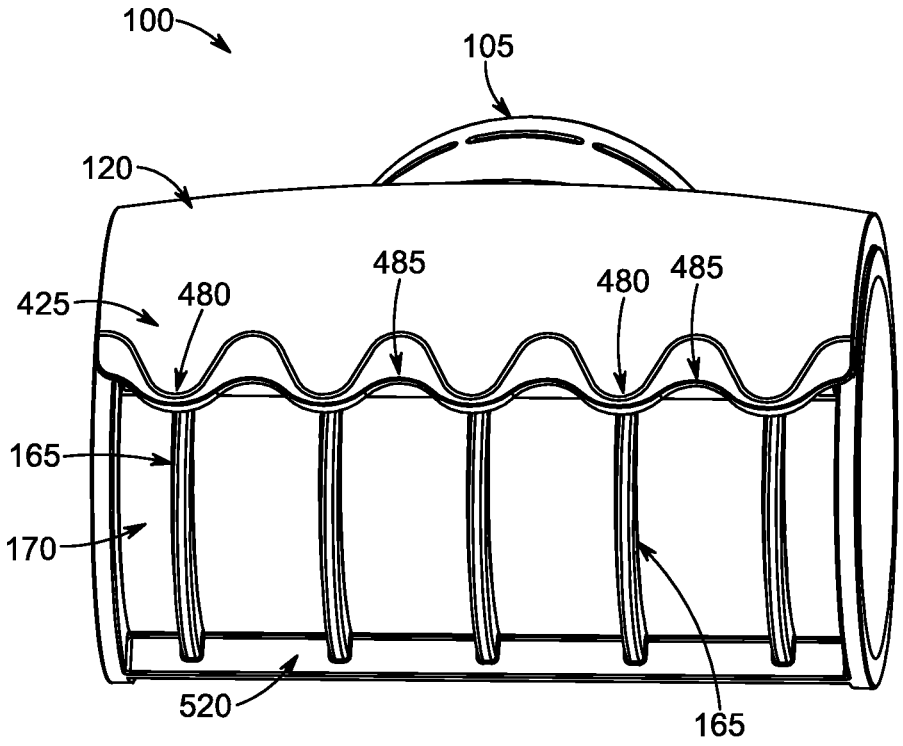
FIG. 17 is a perspective view of another exemplary embodiment of a polishing attachment configured for use with a hair care appliance.

The distribution of the ribs 165 along the length of the base wall 520 can vary. For example, the ribs 165 can be equally spaced from one another along the base wall 520 or can be arranged in a pattern, such that more or less ribs 165 are located in one or more locations along the base wall 520. In one embodiment, the ribs 165 can be positioned in correspondence with features of the scalloped portion 425 of the upper cover 210. The scalloped portion 425 can include projecting features 480 interspersed between groove features 485 as shown in FIGS. 3 and 17. In some embodiments, the ribs 165 can be located along the base wall 520 at locations corresponding to some or all of the projecting features 480 as shown in FIG. 17. Advantageously, providing the ribs 165 at locations corresponding to the projecting feature 480 can create a greater amount of surface area of the heating element 170 that can contact a user's hair. As a result, a greater amount of hair can contact the heating element 170 and the polishing of hair can be improved. In other embodiments, the ribs 165 can also be located along the base wall at locations corresponding to some or all of the groove features 485 and some or all of the projecting features 480 as shown in FIG. 3.

The ribs 165 can provide protection to a user from contacting their skin with heated portions of the hollow barrel 220 and can also guide the combined air flow FC adjacent to the heated surface of the hollow barrel 220. With the barrel 220 mated to the frame 205, the base wall 520 can be spaced apart from the distal edge of the lower portion 215 of the frame 205. In some embodiments, the base wall 520 can abut the distal edge of the lower portion 215.

As further shown in FIG. 11, the barrel 220 can include opposing collars 525 on terminal ends thereof. The collars 525 can form extend around openings to an inner lumen of the hollow barrel 220. The collars 525 can be configured to receive the upper portion 305 of the frame 205 and the upper cover 210 therebetween. In some embodiments, each collar 525 can include a recess 530 within which the tabs 340 of the upper portion 305 can be received to couple the frame 205 with the hollow barrel 220.

As seen in FIGS. 9 and 11, the hollow barrel 220 can also include projections 535 extending radially away from the exterior surface of the hollow barrel 220. The projections 535 can be positioned between a collar 525 and an outer edge of the upper portion 305 of the frame 205. The projections 535 can have a height, measured as a distance extending radially away from the exterior surface of the hollow barrel 220, configured to correspond to a height of the second air flow path F2 formed between the frame 205 and the upper cover 210. The projections 535 can further correspond to a height of the secondary air outlets 155.

Figure 13:
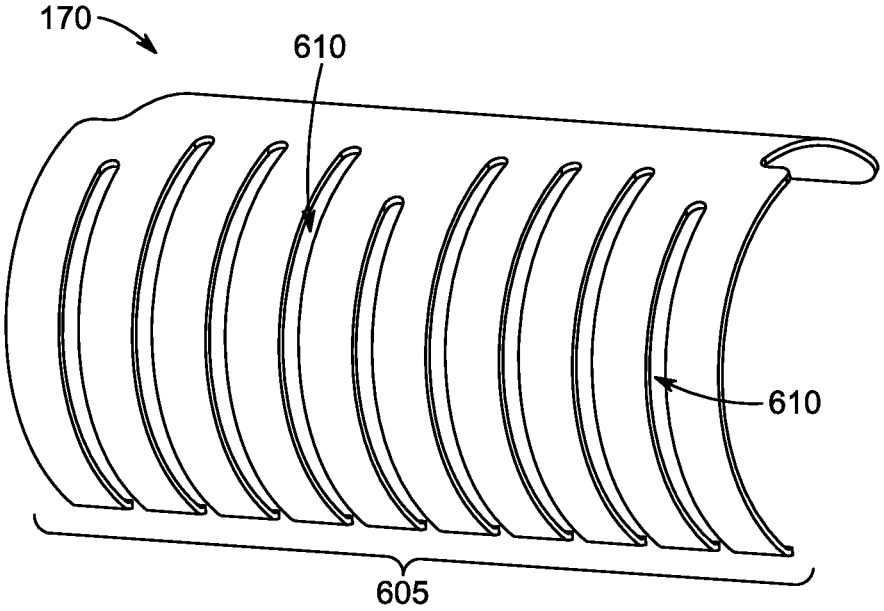
FIG. 13 is a front perspective view of the heating element of FIG. 4.

The hollow barrel 220 can also include a heating element 170, as shown in FIGS. 11-12. The heating element 170 can be received within the recessed portion 515 and can be correspondingly configured to match the size of the recessed portion 515 and the ribs 165. The heating element 170 can include or be formed from a conductive material, such as metal. The heating element 170 can have a hemi-cylindrical shape configured to match the circumferential shape of the hollow barrel 220. The heating element 170 can include a plurality of tines 605, as shown in FIG. 13, with spaces 610 between the respective tines. The length (or height) of the spaces 610 can vary such that a shorter space can be positioned adjacent to a longer space. The arrangement of the spaces 610 can be configured to correspond to the arrangement of the ribs 165 so that when the heating element 170 is received within the recessed portion 515, the tines 605 extend between the ribs 165 and the spaces 610 can receive the ribs 15 therein. The heating element 170 can also include a coating, such as a ceramic coating on an exterior surface of the heating element 170. The coating can be configured to distribute and retain heat received thereon. The heating element 170 can be heated via the first air flow path F1 received at the air inlet 135 when coupled to a hair care appliance.

Figure 14:
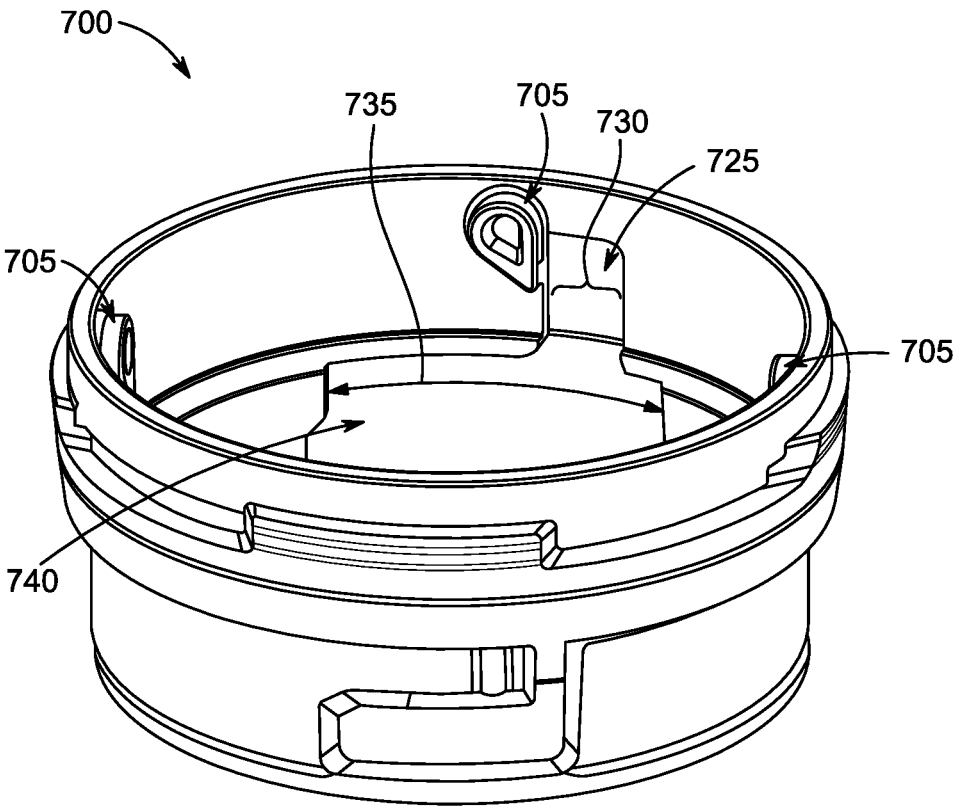
FIG. 14 is a front perspective view of an attachment mating assembly of a hair care appliance configured to couple with a mating mechanism of FIG. 2.

As indicated above, the polisher attachment 100 is configured to mate with a hair care appliance, and thus includes a mating mechanism 125 configured to couple to an attachment mating portion on the hair care appliance. In some embodiments, the mating mechanism 125 can be formed on exterior surfaces of the upper cover 210 and the lower cover 215 as shown in FIGS. 1-3. In other embodiments, the mating mechanism 125 can be formed on an annular ring 455 that surrounds the frame 205, as shown in FIGS. 4-7, and 9. In some embodiments, the mating mechanism 125 can be formed on exterior surfaces of the frame 205 as shown in FIG. 8. While the mating connection between the two components can vary, FIG. 14 illustrates one embodiment of an attachment mating portion 700 on a hair care appliance that is configured to receive and couple with the mating mechanism 125 of the attachment 100. The illustrated attachment mating portion 700 includes one or more protrusions 705 on an inner surface of the attachment mating portion 700. The protrusions 705 can be received within the openings 710 of the slots 715 (shown on the mating mechanism 125 in FIG. 2) and can travel to the receiving end 720 as the user couples the attachment 100 onto the outlet end of the hair care appliance.

The attachment mating portion 700 can also include at least one recess 725 configured to receive a tab or protruding portion of an attachment actuator assembly of the hair care appliance. The attachment actuator assembly can be configured with a latch that is coupled to a spring force mechanism. The spring force mechanism can maintain the latch and the tab portion in a first position in which the tab or protruding portion is positioned within the recess 725 or a second position in which the latch is retracted away from the attachment mating portion 700 causing the tab or protruding portion to move out of the recess 725. Coupling the mating mechanism 125 with the attachment mating portion 700 can cause the spring force mechanism to move the tab portion into the first position without user manipulation of the latch. Uncoupling the mating mechanism 125 from the attachment mating portion 700 can require manual manipulation of the latch by a user to retract the latch and cause the tab portion to move out of the recess 725 allowing removal of the attachment 100 from the hair care appliance. In some embodiments, the user may retract the latch to the second position, affix the mating mechanism 125 to the attachment mating portion 700, and release the latch causing the spring force mechanism to move the latch and tab into the first position.

The recess 725 can have a width 730 corresponding to a width of the tab or protruding portion of the attachment actuator assembly. As the mating mechanism 125 of the attachment 100 is mated with attachment mating portion 700, the protrusions 705 can travel into the slots 715 on the mating mechanism 125. As explained in detail below, once travel of the protrusions 705 into the slots 715 is complete the spring force of the attachment actuator assembly can cause the latch of the attachment actuator assembly to travel toward the attachment mating portion 700 so that the tab portion of the attachment actuator assembly travels into the recession 725 locking the attachment in place to prevent rotation of the attachment 100 on the hair care appliance.

The attachment mating portion 700 can also include an opening 735 along the circumference of the bottom portion of the attachment mating portion 700. The opening 735 can receive the attachment actuator assembly therein. The opening 735 can have a diameter 740 corresponding to a diameter of the attachment actuator assembly.

Figure 15B:
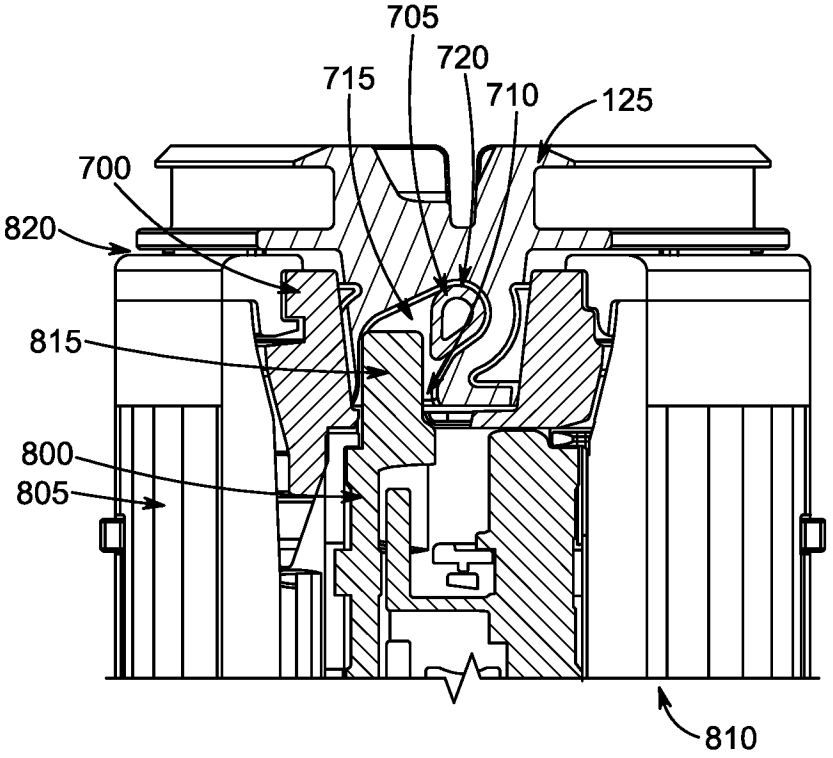
FIG. 15B is a cross-sectional view of a portion of the attachment mating assembly of FIG. 14 coupled with the mating mechanism of FIG. 2.
Figure 15A:
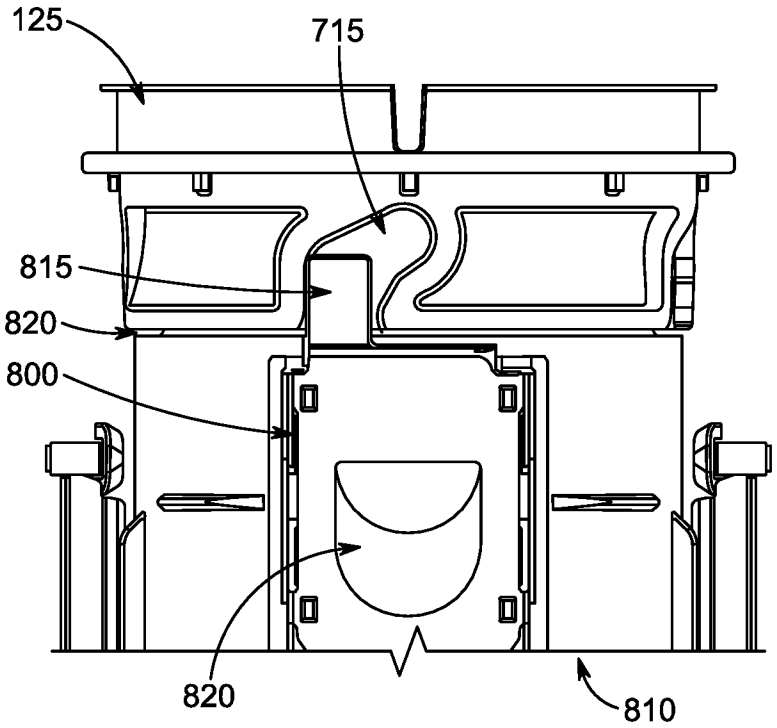
FIG. 15A is a side view of the attachment mating assembly of FIG. 14 coupled with the mating mechanism of FIG. 2.

The attachment actuator assembly 800 of the hair care appliance is shown in more detail in FIGS. 15A and 15B, with the attachment actuator assembly 800 engaged with the mating mechanism 125 of the attachment 100 according to embodiments described herein. Engagement between the mating mechanism 125 and the attachment mating portion 700 can result from aligning the attachment mating portion 700 with the mating mechanism 125 (or vice versa) and urging the attachment mating portion 700 and the mating mechanism 125 together until the attachment actuator assembly 800 engages with the mating mechanism 125.

As shown in FIG. 15A, the attachment mating portion 700 and the body 805 of the hair care appliance 810 have been removed for illustration and engagement of the mating mechanism 125 with the attachment actuator assembly 800 can be viewed. The illustrated attachment actuator assembly 800 includes a latch 820 and a tab 815 coupled to or integrated within the latch 820. The attachment actuator assembly 800 can be a spring drive mechanism, or the like, configured to urge the latch 820 (and thus the tab 815) into engagement with the mating mechanism 125.

As discussed above, the slots 715 of the mating mechanism 125 include an opening 710 at which the protrusions 705 and/or a tab 815 of the attachment mating portion 700 can be received when the attachment 100 is coupled with the hair care appliance 810. When the protrusions 705 reach the receiving end 720, the tab 815 can travel toward the outlet end 820 of the hair care appliance 810 and to be positioned within the opening 710 and the slot 715. In this way, the tab 815 can fill a portion of the slot 715 such that the protrusion 705 is blocked from rotating away from or out of the receiving end 720. As a result, the attachment 100 can be secured to the body 805 and rotation of the attachment 100 relative to the body 805 is significantly reduced or eliminated.

Retracting the latch 820 can cause the tab 815 to travel out of the slot 715 and as the user removes the attachment 100 from the body 805, the protrusions 705 can travel from the receiving end 720 to the opening 710 of the slots 715 to allow uncoupling the attachment 100 from the body 805 of the hair care appliance 810.

FIG. 15B illustrates a cut-away view of the attachment actuator assembly 800 engaged with the mating mechanism 125. The cut-away view shows an internal perspective of the attachment actuator assembly 800 engaged with the mating mechanism 125, as well as one of the protrusions 705 engaged with the mating mechanism 125. The user has coupled the mating mechanism 125 with the attachment mating portion 700 such that the protrusion 705 has traveled into a receiving end 710 located at a terminal end of the slot 715. In the cut-away view illustrated in FIG. 15B, the additional protrusions 705 on the opposite side of the attachment mating portion 700 are not shown but it will be understood that the additional protrusions 705 on the opposite side of the attachment mating portion 700 are also engaged with the slots 715 present on the opposite side of the mating mechanism 125. Once the protrusions 705 are fully inserted into the slot 715, the spring force of the attachment actuator assembly 800 can cause the latch 820 to travel toward the outlet end 820 of the hair care appliance 810 causing the tab 815 to travel into the slot 715 to secure the attachment mating portion 700 (and thus, the attachment 100) to the mating mechanism 125 of the hair care appliance 810. In some embodiments, the tab 815 can be received within the recess 725 of the attachment mating portion 700 and the protrusions 705 can be received within the openings 715 of the mating mechanism 125. The attachment 100 is thus secured to the hair care appliance 810 by the engagement of the protrusions 705 of the attachment mating portion 700 within the receiving end 720 of the slots 715 of the mating mechanism 125. Additionally the protrusions 705 are secured within the slots 715 by the tab 815 of the attachment actuator assembly 800. The tab 815 can be positioned within the opening 710 of the slots 715 to prevent the protrusions 705 from coming out of the opening 710. As a result, the attachment 100 can be attached to the hair care appliance 810 securely and rotation of the attachment 100 relative to the body 805 can be reduced or eliminated.

In use, the attachment 100 can be used to polish, straighten, de-frizz, and improve shine, or otherwise style hair by coupling the attachment 100 to a hair care appliance and engaging the attachment 100 with the user's hair. The hair care appliance can generate air flow that is received at the air inlet 135 of the attachment 100 and directed through the outlets 145 over the heating element 170. A user can hold the hair care appliance coupled with the attachment 100 attached thereto in one hand and position the scalloped portion 425 adjacent to their scalp at a location at which they wish to style their hair. With the hair care appliance powered on such that heated air exits the outlets 145 along the combined air flow path FC, the user can draw the scalloped portion 425 down or otherwise along the length of their hair. The Coanda effect produced via the air flow path FC can draw hair toward the hollow barrel 220 into contact with the heating element 170 to polish, straighten, de-frizz and increase shine of their hair. The user can repeat this process at other desired locations where frizzy, dull, or fly-away hairs may be present. The ribs 165 can protect the users skin from contacting the heating element 170 during styling.

The improved hair polishing attachment 100 described herein and configured for use with a hair care appliance produce a number of advantages. For example, the configuration of the air flow paths F1, F2, and the outlets 145 can generate a Coanda effect via the combined air flow path FC with respect to the heated surface of the hollow barrel 220 where styling is performed. The Coanda effect can draw frizzy or fly-away hair toward the heating element 170 so that heat can be transferred to the hair to reduce frizz, improve shine, and polish hair into a substantially straight, uniform style. The scalloped portion 425 of the upper cover 210 can improve the engagement of the attachment 100 with the hair by providing a high-friction surface that creates tension on the hair as the attachment is drawn over hair for styling. Additionally, the heating element 170 can transfer heat to hair more readily thereby improving the styling efficiency of the attachment 100. As a result of these features, the attachment 100 described herein can reduce the time to polish, straighten, de-frizz or shine hair compared to existing hair care appliance attachments.

As used herein, the term "proximal" can define a location of an element that is upstream of an air flow path and thus closer in proximity to the outlet of a hair care appliance to which the attachment can be coupled or closer to an air inlet of the attachment. The term "proximal" can also refer to a location that is closer to a handle of the hair care appliance at which the user may grasp the hair care appliance. The term "distal" can define a location of an element that is downstream of the air flow path and thus further away from the outlet of the hair care appliance. The term "distal" can also refer to a location that is farther away from the handle of the hair care appliance. The term "distal" can refer to a location that is closer to an outlet of the attachment at which the air flow path exits the attachment. A distal location will be opposite a proximal location and vice versa.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. An attachment for a hair care appliance, comprising:

a nozzle defining a first air flow path extending between a first air inlet and a first air outlet;

a cover coupled to the nozzle such that the cover and nozzle together define a second air flow path between a second air inlet and a second air outlet; and a hollow cylindrical barrel coupled to the nozzle and positioned to receive air flowing out of the first air outlet circumferentially there around, the hollow cylindrical barrel including a plurality of ribs extending around at least a portion of an outer circumference thereof and configured to direct the first air flow path around the at least a portion of the outer circumference of the hollow cylindrical barrel.

2. The attachment of claim 1, further comprising a heating element positioned along the at least a portion of the outer circumference of the hollow cylindrical barrel.

3. The attachment of claim 2, wherein the plurality of ribs extend radially away from the heating element.

4. The attachment of claim 2, wherein the heating element includes a conductive insert disposed on the hollow cylindrical barrel, the conductive insert comprising a plurality of projections extending radially outward therefrom and at least partially around the hollow cylindrical barrel.

5. The attachment of claim 4, wherein the plurality of ribs are interleaved with the plurality of projections.

6. The attachment of claim 4, wherein the conductive insert is positioned within a recessed portion of the hollow cylindrical barrel and extends around at least a portion of a circumference of the hollow cylindrical barrel.

7. The attachment of claim 4, wherein the conductive insert comprises a ceramic coating thereon configured to retain and distribute heat across the conductive insert.

8. The attachment of claim 1, wherein the nozzle has a first substantially cylindrical portion defining the first air inlet configured to couple to an outlet end of a hair care appliance.

9. The attachment of claim 8, wherein the first substantially cylindrical portion tapers from a circumferential opening at the first air inlet to a linear opening at the first air outlet.

10. The attachment of claim 8, wherein the nozzle has a second hemi-cylindrical portion extending from the first substantially cylindrical portion and configured to guide air flow from the first substantially cylindrical portion along a hemi-circumferential path.

11. The attachment of claim 1, wherein the second air flow path comprises at least one opening formed in the cover and open to an ambient environment surrounding the cover.

12. The attachment of claim 1, wherein the first air outlet is positioned between the hollow barrel assembly and nozzle.

13. The attachment of claim 1, wherein the first and second air outlets extend substantially parallel to one another.

14. The attachment of claim 1, wherein the cover comprises a first cover portion positioned on a first side of the frame and defining the second air inlet, and a second cover portion positioned on a second side of the frame and coupled to the first cover portion.

15. The attachment of claim 1, wherein a terminal end of the cover adjacent the second air outlet is scalloped.

16. The attachment of claim 15, wherein the terminal end of the cover comprises a silicon material.

17. The attachment of claim 1, wherein the heating element is configured to receive heat via heated air provided from at least one of the first air outlet and the second air outlet.

18. The attachment of claim 1, wherein air exiting the first air outlet is configured to merge with air exiting the second air outlet to form a combined airflow configured to flow around the portion of the outer circumference of the hollow cylindrical barrel.

19. The attachment of claim 1, wherein the second air outlet is positioned superior to the first air outlet relative to a longitudinal axis extending through the hollow cylindrical barrel.

* * * * *